US009396682B2

(12) United States Patent
Xia et al.

(10) Patent No.: US 9,396,682 B2
(45) Date of Patent: Jul. 19, 2016

(54) GATE DRIVING CIRCUIT, TFT ARRAY SUBSTRATE, AND DISPLAY DEVICE

(71) Applicants: Shanghai AVIC Optoelectronics Co., Ltd., Shanghai (CN); Tianma Micro-Electronics Co., Ltd., Shenzhen (CN)

(72) Inventors: Zhiqiang Xia, Shanghai (CN); Xin Xu, Shanghai (CN); Lina Sun, Shanghai (CN); Dongliang Dun, Shanghai (CN); Huijun Jin, Shanghai (CN)

(73) Assignees: Shanghai AVIC OPTO Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 101 days.

(21) Appl. No.: 14/302,383

(22) Filed: Jun. 11, 2014

(65) Prior Publication Data

US 2015/0213762 A1 Jul. 30, 2015

(30) Foreign Application Priority Data

Jan. 27, 2014 (CN) ..... 2014 1 0040341

(51) Int. Cl.
*G09G 3/36* (2006.01)
*G09G 3/32* (2016.01)

(52) U.S. Cl.
CPC ..... *G09G 3/3266* (2013.01); *G09G 3/3674* (2013.01); *G09G 2310/0281* (2013.01); *G09G 2310/0286* (2013.01)

(58) Field of Classification Search
CPC ..... G09G 3/36; G09G 5/00; G11C 19/00; G06F 3/038
See application file for complete search history.

(56) References Cited

U.S. PATENT DOCUMENTS

2008/0187089 A1* 8/2008 Miyayama ..... G11C 19/28 377/79
2011/0156997 A1* 6/2011 Han ..... G09G 3/3677 345/100
2013/0038583 A1* 2/2013 Shimada ..... G11C 19/28 345/204
2014/0078124 A1* 3/2014 Chen ..... G09G 3/3266 345/205
2014/0168050 A1* 6/2014 Gu ..... G09G 3/3611 345/100
2014/0347349 A1* 11/2014 Kim ..... G09G 3/3677 345/213

FOREIGN PATENT DOCUMENTS

CN 103280196 A 9/2013
KR 20030032199 A 4/2003

* cited by examiner

*Primary Examiner* — Pegeman Karimi
(74) *Attorney, Agent, or Firm* — Alston & Bird LLP

(57) ABSTRACT

A gate driving circuit is disclosed. The gate driving circuit includes m stages of shift registers, where each stage of shift register includes a first reset terminal, a first input terminal, and an output terminal. A first input terminal of the first stage of shift register is configured to receive an initial signal, and a first reset terminal of the first stage of shift register is configured to receive a reset signal. In addition, first reset terminals of the second to i-th stages of shift registers are configured to receive first signals, where a first reset terminal of each stage of shift register is electrically connected to an output terminal of the previous stage of shift register to receive an output signal from the previous stage of shift register, such that the output signal from the previous stage of shift register causes the next stage of shift register to reset.

19 Claims, 11 Drawing Sheets

GATE DRIVING CIRCUIT, TFT ARRAY SUBSTRATE, AND DISPLAY DEVICE

CROSS-REFERENCES TO RELATED APPLICATIONS

This application claims the benefit of priority to Chinese Patent Application No. 201410040341.1 filed with the Chinese Patent Office on Jan. 27, 2014 and entitled "Gate Driving Circuit, TFT Array Substrate, Display Panel and Display device", the content of which is incorporated herein by reference in its entirety.

TECHNICAL FIELD

The present disclosure relates to the field of display technologies, in particular to a gate driving circuit, a TFT array substrate, a display panel and a display device.

BACKGROUND OF THE INVENTION

A Thin Film Transistor (TFT) array substrate of a display device such as a Liquid Crystal Display (LCD) device and an Organic Light Emitting Diode Display (OLED) device usually includes a gate driving circuit, which provides a gate driving signal for the TFT array substrate. The gate driving circuit includes a plurality of stages of shift registers. In actual use, the level outputted from the shift register will be floating to a high voltage level before the scanning of the shift register, thus degrading the display performance of display device.

BRIEF SUMMARY OF THE INVENTION

One inventive aspect is a gate driving circuit. The gate driving circuit includes m stages of shift registers connected to each other in series, where each stage of shift register includes a first reset terminal, a first input terminal, and an output terminal. A first input terminal of the first stage of shift register is configured to receive an initial signal, and a first reset terminal of the first stage of shift register is configured to receive a reset signal, and the reset signal causes the first stage of shift register to reset before scanning. In addition, first reset terminals of the second to i-th stages of shift registers are configured to receive first signals, which cause the second to i-th stages of shift registers to reset before scanning, where a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, where i, m and n are positive integers, and $m>3$, $2\leq i\leq m/2$, $i<n\leq m$.

Another inventive aspect is a TFT array substrate, including a gate driving circuit. The gate driving circuit includes m stages of shift registers connected to each other in series, where each stage of shift register includes a first reset terminal, a first input terminal, and an output terminal. A first input terminal of the first stage of shift register is configured to receive an initial signal, and a first reset terminal of the first stage of shift register is configured to receive a reset signal, and the reset signal causes the first stage of shift register to reset before scanning. In addition, first reset terminals of the second to i-th stages of shift registers are configured to receive first signals, which cause the second to i-th stages of shift registers to reset before scanning, where a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, where i, m and n are positive integers, $m>3$, $2\leq i\leq m/2$, $i<n\leq m$.

Another inventive aspect is a display device, including a TFT array substrate, where the TFT array substrate includes a gate driving circuit. The gate driving circuit includes m stages of shift registers connected to each other in series, where each stage of shift register includes a first reset terminal, a first input terminal, and an output terminal. A first input terminal of the first stage of shift register is configured to receive an initial signal, and a first reset terminal of the first stage of shift register is configured to receive a reset signal, and the reset signal causes the first stage of shift register to reset before scanning. In addition, first reset terminals of the second to i-th stages of shift registers are configured to receive first signals, which cause the second to i-th stages of shift registers to reset before scanning, where a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, where i, m and n are positive integers, and $m>3$, $2\leq i\leq m/2$, $i<n\leq m$.

BRIEF DESCRIPTION OF THE DRAWINGS

The drawings described herein, which form a part of the present disclosure, are intended to provide further understanding on the present disclosure, but do not unduly limit the present disclosure. In the drawings.

DETAILED DESCRIPTION OF THE PREFERRED EMBODIMENTS

The present disclosure will be completely described below in more detail in conjunction with the accompanying drawings and specific embodiments. It can be understood that, the specific embodiments described here are only intended to explain the present invention, but not to limit present invention. Besides, for the convenience of description, the drawings only show parts relevant to the present invention, not all of the disclosure.

A gate driving circuit normally includes a plurality of stages of shift registers sequentially connected in series. In a scan period of each frame, these cascaded stages of shift registers are scanned in sequence, and each stage of shift register sequentially outputs an output signal (i.e. a gate driving signal), and each gate line in the TFT array substrate is configured to receive a corresponding gate driving signal. When the respective stage of shift register is not scanned, the respective stage of shift register outputs a low level output signal.

It shall be noted that, during the scanning period of each frame in the gate driving circuit, each stage of shift register needs to be reset before scanning and needs to be reset after scanning. The reset before scanning means that the voltage level of the output terminal of the respective stage of shift register is pulled down to a low level before the respective stage of shift register is scanned, in other words, the respective stage of shift register is cleared or reset, and that is, the reset before scanning ensures that the level of the output terminal of respective stage of shift register is always maintained at a low level before the respective stage of shift register is scanned, so that the quality of the displayed image is improved. The reset after scanning means that the voltage level of the output terminal of the respective stage of shift register is pulled down to a low level after the respective stage of shift register is scanned, i.e. after the gate driving signal is outputted from the respective stage of shift register, thereby ensuring that the level of the output terminal of respective stage of shift register is maintained at a low level after the respective stage of shift register is scanned, to avoid interference with the displayed image, and prepares for the next scan. The embodiments of the present invention are described mainly with examples of resetting the gate driving circuit before scanning, in connection with specific embodiments.

Figure 1A:
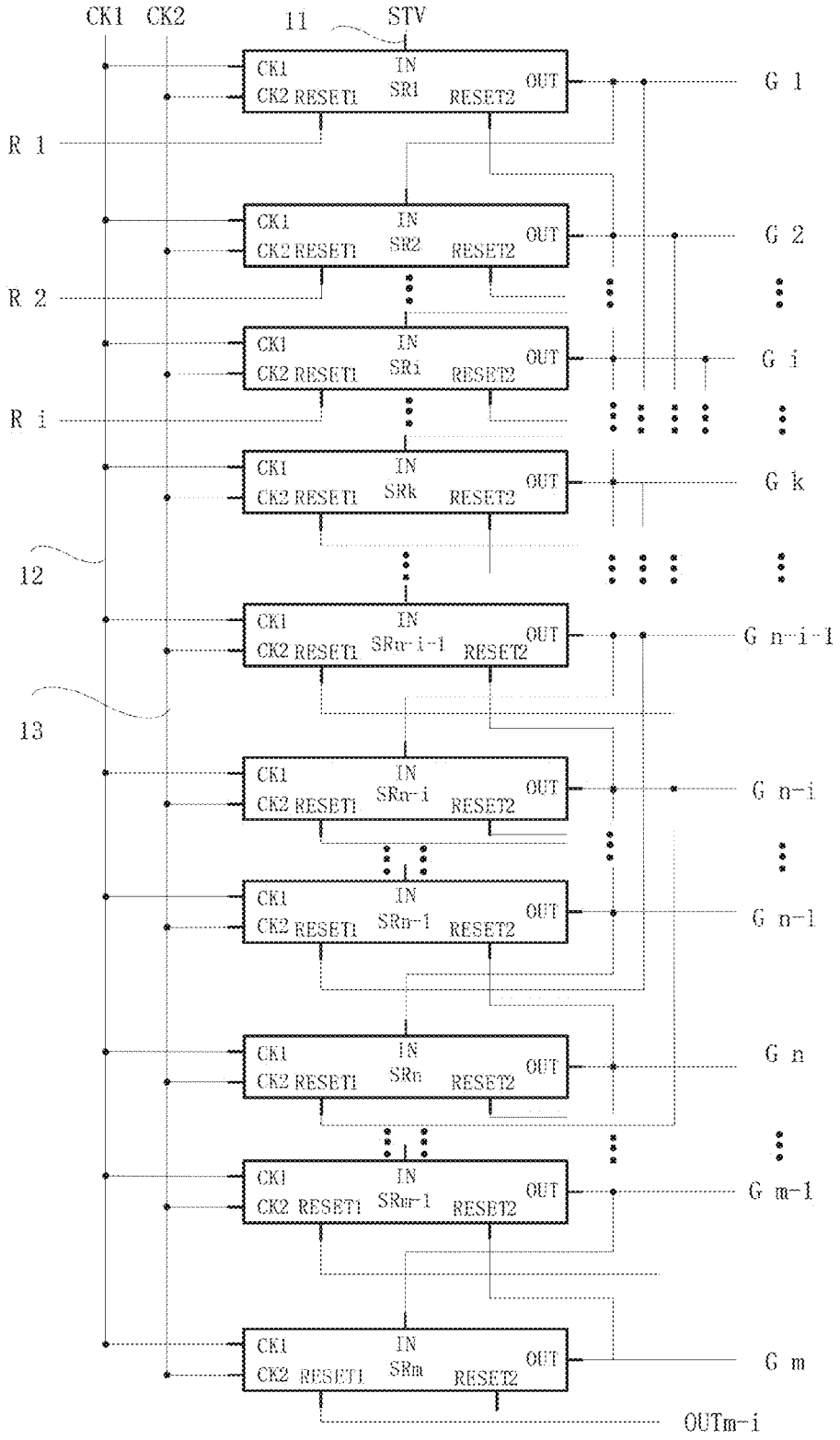
FIG. 1*a* is a schematic diagram showing the structure of a gate driving circuit according to an embodiment of the present invention.

FIG. 1*a* is a schematic diagram showing the structure of a gate driving circuit according to an embodiment of the present invention. The present embodiment is described below with an example of forward scanning of the gate driving circuit. In other embodiments, the gate driving circuit can also be scanned backward(reverse scan), and the present embodiment is not limited thereto.

Referring to FIG. 1*a*, the gate driving circuit includes m stages of shift registers SR1, SR2, . . . , SRi, . . . , SRn−1, SRn, SRn+1, . . . , SRm−1, and SRm, connected to each other in series, where i, m and n are positive integers, and m>3, 2≤i≤m/2, i<n≤m. Each stage of shift register includes a first reset terminal RESET1, a first input terminal IN, and an output terminal OUT. The output signal from the output terminal OUT of each stage of the shift register is used to drive a responding gate line connected to the output terminal OUT, and this output signal forms the gate driving signal.

Meanwhile, FIG. 1*a* also shows: reset lines R1, R2, . . . , Ri which are respectively connected to and provide first signals to the first reset terminals RESET1 of the shift registers SR1, SR2, . . . , SRi, so that the shift register SR1, SR2, . . . , SRi may be reset before scanning; gate lines G1 to Gm, which are configured to receive the output signals from the shift registers SR1, SR2, . . . , SRi, respectively; and an initial signal line 11 which is configured to provide an initial signal STV.

Specifically, the first input terminal IN of the first stage of shift register SR1 is connected to the initial signal line 11, to receive the initial signal STV; the first reset terminal RESET1 of the first stage of shift register SR1 is connected to the reset line R1 to receive a reset signal, which resets the first stage of shift register SR1 before scanning, namely the first stage of shift register SR1 is reset before the first stage of shift register SR1 is scanned. The first reset terminals RESET1 of the second to i-th stages of shift registers SR2, . . . , SRi are configured to receive the first signals, which reset the second to i-th stages of shift registers SR2, . . . , SRi before scanning. The first reset terminal RESET1 of the n-th stage of shift register SRn is electrically connected to the output terminal OUT of the (n−i)-th stage of shift register SRn−i, to receive the output signal from the output terminal OUT of the (n−i)-th stage of shift register SRn−i, and the output signal from the output terminal OUT of the (n−i)-th stage of shift register SRn−i controls the n-th stage of shift register SRn to reset before scanning.

Furthermore, in the present embodiment, the first signals are the reset signals from the reset lines R1, R2, . . . , Ri. Before the scan of one frame, the reset line R1 applies the reset signal to the first stage of shift register SR1. The first reset terminal RESET1 of the first stage of shift register SR1 receives the reset signal, so that the first stage of shift register SR1 is reset before scanning, thereby resetting the first stage of shift register SR1 before the first stage of shift register SR1 begins an operation cycle (i.e. the first stage of shift register SR1 is scanned), so that the output terminal OUT of the first stage of shift register SR1 is maintained at a low level. After the first stage of shift register SR1 is reset, the initial signal line 11 provides the initial signal STV to the first input terminal IN of the first stage of shift register SR1; the first input terminal IN of the first stage of shift register SR1 receives the initial signal STV, to start the scan period of one frame for the gate driving circuit, so that each stage of shift register in the gate driving circuit sequentially outputs a gate driving signal, to drive the gate lines in the TFT array substrate. In addition, the output signal (i.e. the gate driving signal) from the output terminal OUT of the first stage of shift register SR1 is also applied to the first reset terminal of the (1+i)-th stage of shift register, to reset the (1+i)-th stage of shift register (not shown) before scanning, namely, the (1+i)-th stage of shift register is reset before the (1+i)-th stage of shift register is scanned.

The first reset terminals RESET1 of the second to i-th stages of shift registers SR2, . . . , SRi receive the first signals, to enable the second to i-th stages of shift registers SR2, . . . , SRi to reset before scanning, namely, the second to i-th stages of shift registers SR2, . . . , SRi are respectively reset before the second to i-th stages of shift registers SR2, . . . , SRi are respectively scanned; wherein, the first signals adopts the reset signals or initial signal. Typically, the reset signals are outputted from a reset signal bus R, the initial signal STV outputted from the initial signal line 11, the reset signal bus R and the initial signal line 11 are both connected to a driver Integrated Circuit (IC) (not shown), which is generally located on a step of the TFT array substrate (not shown).

Specifically, the reset lines R2 to Ri are respectively connected to the first reset terminals RESET1 of the second to i-th stages of shift registers SR2, . . . , SRi to provide the first signals, so that the reset of the second to i-th stages of shift registers SR2, . . . , SRi is completed before scanning. For example, the reset line R2 provides the first signal to the first reset terminal RESET1 of the second stage of shift register SR2; where, the first signal may be the initial signal provided by the initial signal line 11, or the reset signal provided by the reset signal bus R. After receiving the reset signal, the second stage of shift register SR2 is reset before scanning, so that the output terminal OUT of the second stage of shift register SR2 is maintained at a low level before scanning; similarly, the third to i-th stages of shift registers SR3, . . . , SRi are reset before scanning. After the second stage of shift register SR2 has been reset before its scanning, the output signal from the output terminal OUT of the second stage of shift register SR2 is also applied to the first reset terminal of the (2+i)-th stage of shift register, so that the (2+i)-th stage of shift register is reset before its scanning. Similarly, the (3+i)-th stage of shift register SR3+i to the m-th stage of shift register SRm are accordingly reset before their scanning. That is, the first reset terminal RESET1 of the n-th stage of shift register SRn is electrically connected to the output terminal OUT of the (n−i)-th stage of shift register SRn−i, to receive the output signal from the output terminal OUT of the (n−i)-th stage of shift register SRn−i, so that the output signal from the output terminal OUT of the (n−i)-th stage of shift register SRn−i controls the n-th stage of shift register SRn to reset before scanning.

Furthermore, the (i+1)-th stage of shift register SRi+1 to the m-th stage of shift register SRm are reset before scanning: specifically, in the case of the n-th stage of shift register SRn for example, when the (n−i)-th stage of shift register SRn−i in the gate driving circuit is scanned, the output signal from the output terminal OUT of the (n−i)-th stage of shift register SRn−i is applied to the gate line connected to the (n−i)-th stage of shift register SRn−i; meanwhile, the output signal from the output terminal OUT of the (n−i)-th stage of shift register SRn−i is transmitted to the first reset terminal RESET1 of the n-th stage of shift register SRn, so that the n-th stage of shift register SRn is reset before its scanning, that is, the output terminal OUT of the n-th stage of shift register SRn is maintained at a low level before scanning. For example, when n=m, the first reset terminal RESET1 of the m-th stage of shift register SRm is electrically connected to the output terminal OUT of the (m−i)-th stage of shift register SRm−1, to receive the output signal from the output terminal OUT of the (m−i)-th stage of shift register, so that the m-th stage of shift register SRm is reset (and hence has a low voltage level) before scanning, and the output terminal OUT of the m-th stage of shift register SRm is maintained at a low level; and when n=m−1, the first reset terminal RESET1 of the (m−1)-th stage of shift register SRm−1 is electrically connected to the output terminal OUT of the (m−1−i)-th stage of shift register SRm−1−i, to receive an output signal from the output terminal OUT of the (m−1−i)-th stage of shift register SRm−1−i, so that the (m−1)-th stage of shift register SRm−1 is reset before scanning, and the output terminal OUT of the (m−1)-th stage of shift register SRm−1 is maintained at a low level before scanning of the (m−1)-th stage of shift register SRm−1.

Furthermore, referring to FIG. 1*a*, in the present embodiment, the gate driving circuit also includes a first clock signal line 12, a second clock signal line 13, a first level signal line (not shown), a second level signal line (not shown) and a plurality of gate lines (G1-Gm). Each stage of shift register (SR1-SRm) includes a first clock signal terminal CK1, a second clock signal terminal CK2 and a second reset terminal RESET2, and the shift registers (SR1-SRm) are connected to the gate lines (G1-Gm), respectively.

Specifically, the first clock signal terminal CK1 of each stage of shift register (SR1-SRm) is electrically connected to the first clock signal line 12, to receive a first clock signal provided by the first clock signal line 12; and the second clock signal terminal CK2 of each stage of shift register (SR1-SRm) is electrically connected to the second clock signal line 13, to receive a second clock signal. The first clock signal line 12 and the second clock signal line 13 respectively provide the first clock signal and the second clock signal.

The first level signal line and the second level signal line provide a first level signal and a second level signal required by each stage of shift register.

Furthermore, the output signal from the output terminal OUT of the k-th stage of shift register SRk is also transmitted to the first input terminal IN of the (k+1)-th stage of shift register SRk+1, to drive the (k+1)-th stage of shift register SRk+1 to scan (i.e. to operate), that is, to enable the (k+1)-th stage of shift register SRk+1, thus the (k+1)-th stage of shift register SRk+1 enters into an operation cycle, and hence the output terminal OUT of the (k+1)-th stage of shift register SRk+1 outputs the corresponding gate driving signal. Specifically, by transmitting the gate driving signal outputted by the output terminal of the k-th stage of shift register SRk to the first input terminal IN of the (k+1)-th stage of shift register SRk+1, the (k+1)-th stage of shift register SRk+1 is enabled; in this way, the shift registers are enabled (i.e. operate) stage by stage, where, k is a positive integer, and $1 \leq k < m$.

Specifically, for example in the case of the first stage of shift register SR1, the output signal of the first stage of shift register SR1 is transmitted to the first input terminal IN of the second stage of shift register SR2, so that the second stage of shift register SR2 is enabled to operate, and hence the output signal outputted by the output terminal OUT of the second stage of shift register SR2 is provided to the gate line G2 and the first input terminal IN of the third stage of shift register SR3.

Furthermore, the output terminal OUT of the (k+1)-th stage of shift register SRk+1 is connected to the second reset terminal RESET2 of the k-th stage of shift register SRk. The second reset terminal RESET2 of the k-th stage of shift register SRk receives the output signal from the output terminal OUT of the (k+1)-th stage of shift register SRk+1, so that the k-th stage of shift register SRk is reset at a low level after its scanning and then maintains its output terminal OUT at a low level. Specifically, upon the scanning of the (k+1)-th stage of shift register SRk+1 in the gate driving circuit, the output signal from the output terminal OUT of the (k+1)-th stage of shift register SRk+1 is applied to the gate line Gk+1; meanwhile, the output signal from the output terminal OUT of the (k+1)-th stage of shift register SRk+1 is applied to the second reset terminal RESET2 of the k-th stage of shift register SRk, and controls the k-th stage of shift register SRk to be reset after its scanning. Specifically, in the case of the second stage of shift register SR2 for example, the output terminal OUT of the second stage of shift register SR2 outputs a gate driving signal and transmits the gate driving signal to the second reset terminal RESET2 of the first stage of shift register SR1, so that the first stage register SR1 is reset after scanning; likewise, the other stages of shift registers are also reset after scanning in the same way.

Figure 1B:
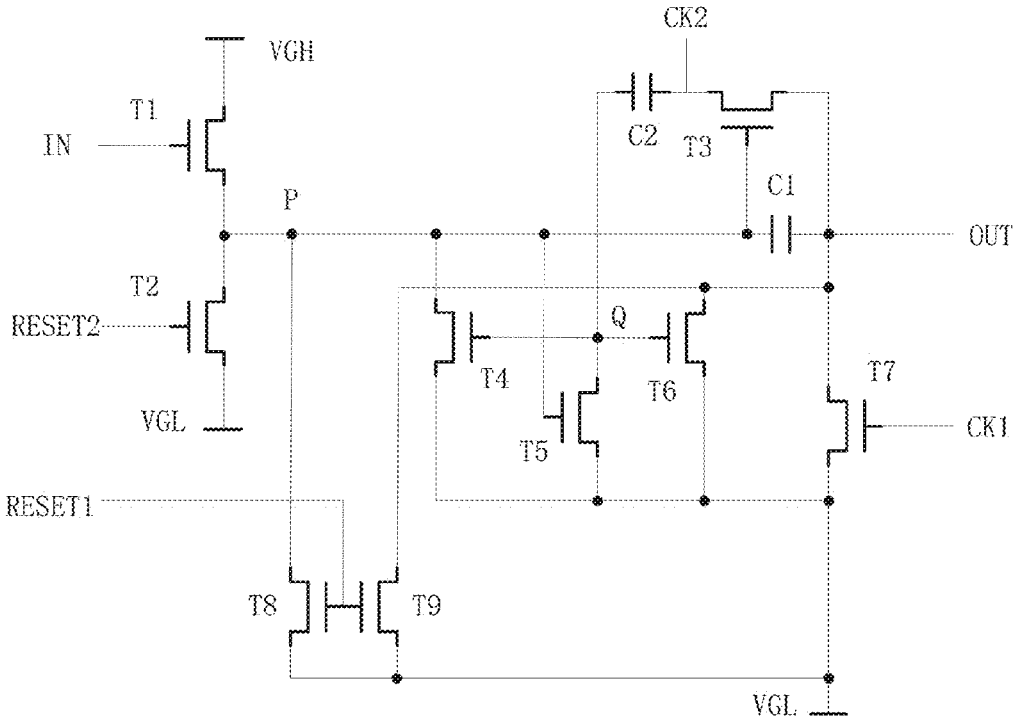
FIG. 1*b* is a schematic diagram showing an optional structure of a shift register in the gate driving circuit according to an embodiment of the present invention.

Referring to FIG. 1*b*, which shows a schematic diagram of an optional structure of a shift register in the gate driving circuit according to an embodiment of the present invention, and the shift register includes:

a first transistor T1, where a gate electrode of the first transistor is electrically connected to the first input terminal IN of the stage of shift register, and a source electrode of the first transistor is electrically connected to the first level signal line VGH to receive the first level signal;

a second transistor T2, where a gate electrode of the second transistor is electrically connected to the second reset terminal RESET2 of the stage of shift register, a drain electrode of the second transistor is electrically connected to the drain electrode of the first transistor T1, and a source electrode of the second transistor is electrically connected to the second level signal line VGL to receive the second level signal;

a third transistor T3, where a gate electrode of the third transistor is electrically connected to the drain electrode of the first transistor T1, and also electrically connected to the output terminal OUT via a first capacitor C1, a drain electrode of the third transistor is electrically connected to the output terminal OUT, and a source electrode of the third transistor is connected to the second clock signal terminal CK2 to receive the second clock signal from the second clock signal line CK2;

a fourth transistor T4, where a drain electrode of the fourth transistor is electrically connected to the drain electrode of the first transistor T1, and a source electrode of the fourth transistor is connected to the second level signal line VGL to receive the second level signal;

a fifth transistor T5, where a gate electrode of the fifth transistor is electrically connected to the drain electrode of the first transistor T1, a source electrode of the fifth transistor is connected to the second clock signal terminal CK2 via a second capacitor C2, i.e. to the second clock signal line via a second capacitor C2, and a drain electrode of the fifth transistor is connected to the second level signal line VGL to receive the second level signal;

a sixth transistor T6, where a gate electrode of the sixth transistor is electrically connected to the gate electrode of the fourth transistor T4 and the source electrode of the fifth transistor T5, a source electrode of the sixth transistor is electrically connected to the output terminal OUT, and a drain electrode of the sixth transistor is connected to the second level signal VGL to receive the second level signal;

a seventh transistor T7, where a gate electrode of the seventh transistor is electrically connected to the first clock signal terminal CK1 to receive the first clock signal, a drain electrode of the seventh transistor is electrically connected to the output terminal OUT, and a source electrode of the seventh transistor is connected to the second level signal line VGL to receive the second level signal;

an eighth transistor T8, where a gate electrode of the eighth transistor is electrically connected to the first reset terminal RESET1, a drain electrode of the eighth transistor is electrically connected to the drain electrode of the first transistor T1, and a source electrode of the eighth transistor is connected to the second level signal line VGL to receive the second level signal; and a ninth transistor T9, a gate electrode of the ninth transistor is electrically connected to the first reset terminal RESET1 and the gate electrode of the eighth transistor T8, a source electrode of the ninth transistor is electrically connected to the output terminal OUT, and a drain electrode of the ninth transistor is connected to the second level signal line VGL to receive the second level signal.

Specifically, referring to FIGS. 1*a* and 1*b*, in the present embodiment, the n-th stage of shift register SRn is reset before scanning as follows: the first reset terminal RESET1 of the n-th stage of shift register SRn receives the output signal from the output terminal OUT of the (n−i)-th stage of shift register SRn−i, so that the output signal received by the first reset terminal RESET1 is applied to both the gate electrodes of the eighth and ninth transistors T8 and T9 of the n-th stage of shift register SRn, to control the turning on or off of the eighth and ninth transistors T8 and T9.

When the eighth transistor T8 and the ninth transistor T9 of the n-th stage of shift register SRn are turned on, the level of the drain electrode of the first transistor T1 of the n-th stage of shift register SRn and the level of the output terminal of the n-th stage of shift register SRn are pulled down to a low level (i.e. the level of the second level signal) by the second level signal, so that the n-th stage of shift register SRn is reset before its scanning. More specifically, the gate driving signal outputted by the (n−i)-th stage of shift register SRn−i (i.e. the signal outputted by the (n−i)-th stage of shift register SRn−i) is applied to both the gate electrodes of the eighth transistor T8 and the gate electrode of the ninth transistor T9 of the n-th stage of shift register SRn, to control both the eighth transistor T8 and the ninth transistor T9 to turn on. The turning on of the eighth transistor T8 causes that: the second level signal is transmitted to a point P, and therefore the level of the point P is pulled down to a low level, that is, the level of the drain electrode of the first transistor T1 is pulled down to a low level. The level of the output terminal OUT is pulled down to a low level through the turned-on ninth transistor T9. Therefore, the levels of the drain electrode and the output terminal of the first transistor T1 are pulled down to a low level through the turned-on eighth transistor T8 and the turned-on ninth transistor T9, so that the n-th stage of shift register SRn is reset before its scanning.

Specifically, referring to FIGS. 1*a* and 1*b*, in the present embodiment, in the case that the first stage of shift register SRi is reset before scanning, the reset terminal RESET1 of the first stage of shift register SR1 receives the reset signal which controls the turning on or off of the eighth transistor T8 and the ninth transistor T9 of the first stage of shift register SR1. When the eighth transistor T8 and the ninth transistor T9 of the first stage of shift register SR1 are turned on, the level of the drain electrode of the first transistor T1 of the first stage of shift register SR1 and the level of the output terminal OUT of the first stage of shift register SR1 are pulled down to a low level (i.e. the level of the second level signal) by the second level signal through the eighth transistor T8 and the ninth transistor T9, so that the first stage of shift register SR1 is reset before its scanning.

Specifically, referring to FIG. 1*a* and FIG. 1*b*, in the present embodiment, the second to i-th stages of shift registers SR2, . . . , SRi are reset before scanning as follows: the first reset terminals RESET1 of the second to i-th stages of shift registers SR2, . . . , SRi receive the first signals (the first signal can be an initial signal or a reset signal, in the present embodiment, the first signal is a reset signal for example, but the present invention is not limited thereto) which control the turning on or off of the eighth transistor T8 and the ninth transistor T9 of the second to i-th stages of shift registers SR2, . . . , Sri correspondingly. When the eighth transistor T8 and the ninth transistor T9 of each of the second to i-th stages of shift registers SR2, . . . , SRi are turned on, the level of the drain electrode of the first transistor T1 of said each of the second to i-th stages of shift registers SR2, . . . , SRi and the level of the output terminal OUT of said each of the second to i-th stages of shift registers SR2, . . . , SRi are pulled down to a low level (i.e. the level of the second level signal) by the second level signal through the eighth transistor T8 and the ninth transistor T9, so that the second to i-th stages of shift registers SR2, . . . , SRi are reset before scanning.

Figure 1C:
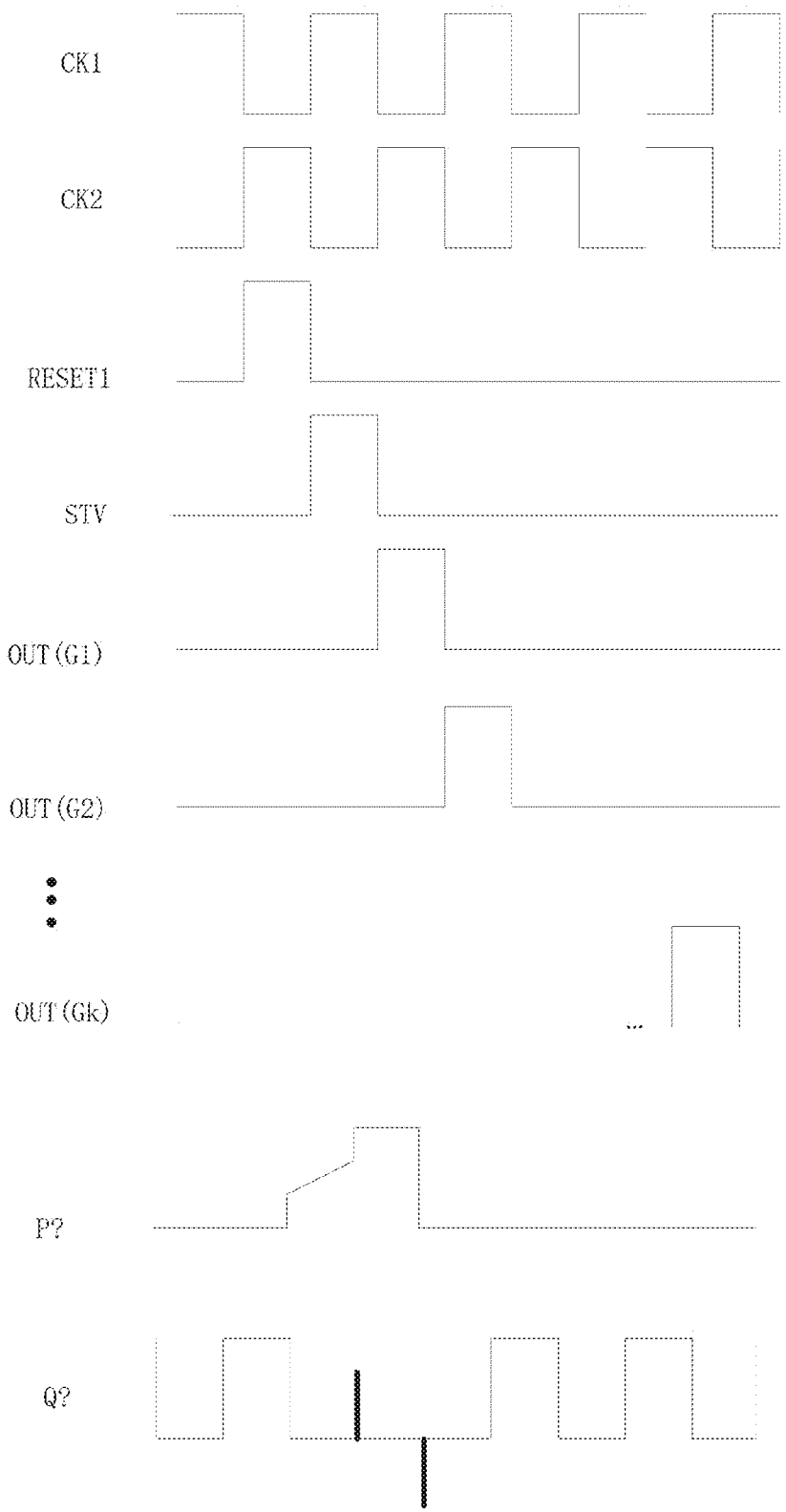
FIG. 1*c* is a schematic diagram showing the time sequence diagram of the n-th stage of shift register in the gate driving circuit according to an embodiment of the present invention.

FIG. 1*c* is a schematic diagram showing the time sequence diagram of the shift register in the gate driving circuit in the present embodiment.

Referring to FIGS. 1*a*, 1*b* and 1*c*, the first input terminals IN of the shift registers respectively receives signals (the first stage of shift register SR1 receives the initial signal, and the k-th stage of shift register SRk receives the output signal from the (k+1)-th stage of shift register SRk+1), so that the shift register enters an operation cycle; specifically, for example, an operation cycle of the second stage of shift register SR2 may include a pull-up stage and a pull-down stage.

In the pull-up stage, the output signal from the first stage of shift register SR1 controls the first transistor T1 of the second stage of shift register SR2 to turn on, and the level of the drain electrode of the first transistor T1 (i.e. the level of the point P) is pulled up to the first level by the first level signal through the turned-on the first transistor T1, so that the third transistor T3 is turned on; the second clock signal is transmitted to the output terminal OUT of the second stage of shift register through the turned-on third transistor T3, and the output terminal OUT outputs the corresponding output signal.

Specifically, referring to FIGS. 1*a*, 1*b* and 1*c*, the output signal of the first stage of shift register SR1 controls the first transistor T1 of the second stage of shift register SR2 to turn on, so that the level of the point P is pulled up to the first level by the first level signal through the first transistor T1; and hence the third transistor T3 is controlled to turn on, so that the level of the point P (i.e., the drain electrode of the first transistor T1) is further pulled up to the second level by the second clock signal through the turned-on third transistor T3, so that the second stage of shift register SR2 outputs the gate driving signal. When the point P is at the second level, that is, it has the value of the level of the second level signal, the increase of the level of the Q point is suppressed, maintaining the output terminal OUT of the second stage of shift register SR2 to output the gate driving signal.

In the pull-down stage, the level of the drain electrode of the first transistor T1 is pulled to the first level by the second clock signal through the turned-on third transistor T3; and the second reset terminal RESET2 receives the output signal from the output terminal OUT of the third stage of shift register SR3, and the output signal controls the second transistor T2 to turn on, which then pulls the drain electrode of the first transistor T1 to a low level and enables the fourth transistor T4 and the sixth transistor T6 to be turned on, and the output terminal OUT of the second stage of shift register outputs a low level signal, so that the second stage of shift register SR2 is reset after scanning.

Specifically, referring to FIG. 1*a*, FIG. 1*b* and FIG. 1*c*; when the level of the second clock signal is down, the level of the point P is down to the first level by means of coupling of the second capacitor C2; meanwhile the gate driving signal of the third stage of shift register SR3 is applied to the second transistor T2, so that the second transistor T2 is turned on; the level of the point P is pulled again down to a low level by the second level signal through the second transistor T2, to lose suppression to the Q point; the second clock signal again jumps to a high level, and pulls the level of the Q point up to a high level, to turn on the fourth transistor T4 and the sixth transistor T6, which makes the levels of the point P and the output terminal OUT back to a low level, so that the second stage of shift register SR2 is reset after scanning.

Optionally, in the present embodiment, the first clock signal and the second clock signal both are pulse signals; and the first clock signal has a high voltage level in a range between 12V and 15V, and the first clock signal has a low voltage level in a range between −8V and −12V; likewise, the second clock signal has a high voltage level in a range between 12V and 15V, and the second clock signal has a low voltage level in a range between −8V and −12V. In the present embodiment, the first clock signal is inverse to the second clock signal.

Optionally, in the present embodiment, the initial signal is a pulse signal, which has a high voltage level in a range between 12V and 15V, and which has a low voltage level in a range between −8V and −12V.

Optionally, in the present embodiment, the first level signal has a voltage level in a range between 12V and 15V, and the first level signal generally is a constant high level signal; the second level signal has a voltage level in a range between −8V and −12V, and the second level signal generally is a constant low level signal.

It shall be noted that in the present embodiment, the gate driving circuit can apply an unilateral-driving for the TFT array substrate, that is, the gate driving circuit is only located at one side of the TFT array substrate display region; alternatively, the gate driving circuit can also apply a bilateral-driving, that is, the gate driving circuit is located at both sides of the TFT array substrate display region. For the unilateral-driving or the bilateral-driving, in the present embodiment, the gate driving circuit is also applicable to a forward scan and a backward scan. In the present embodiment, the first transistor T1 to the ninth transistor T9 are NMOS transistors, but in other embodiment, the first transistor T1 to the ninth transistor T9 may also be PMOS transistors. When the first transistor T1 to the ninth transistor T9 are PMOS transistors, the signals applied or provided, such as the reset signal, the initial signal, the first clock signal, the second clock signal, the first level signal and the second level signal etc., are inverse to those in the present embodiment, respectively.

The gate driving circuit, the TFT array substrate and the display device provided by present embodiment, include m serially-connected stages of shift registers, each of which is reset before scanning; where, resetting of the n-th stage of shift register before scanning is enabled by an output signal from the output terminal of the (n−i)-th stage of shift register. Because of this, during the scan process by the shift registers in the gate driving circuit, each stage of shift register is reset before its scanning. Also, because of $1 \leqslant i \leqslant m/2$, the excessive time interval between the resetting before scanning of each stage of shift register (i.e. the resetting before the enabled scanning of the stage of shift register, that is, the resetting of the stage of shift register before this stage of shift register outputs a gate driving signal) and the enabled scanning of the stage of shift register is avoided, that is, the time interval between the resetting before scanning of each stage of shift register and the enabled scanning of the stage of shift register is reduced. For example, in the prior art, if the scan time period for each stage of shift register is about 16 ms, for the m-th stage of shift register (i.e., the last stage of shift register), the time interval between the resetting before scanning of the last stage of shift register and the enabled scanning of the last stage of shift register is (m−1)*16 ms; however, in the present embodiment, if i is equal to 2 for example, then the time interval between the resetting before scanning of the last stage of shift register and the enabled scanning of the last stage of shift register is 2*16 ms, even in other embodiments, the time interval between the resetting before scanning of the last stage of shift register and the enabled scanning of the last stage of shift register is also less than (m−1)*16 ms, thus greatly reducing the time interval between the reset time before scanning of the last stage of shift register and the scan time of the last stage of shift register, which is the same as the other stages of shift registers, that is, the time interval between the reset time before scanning of each stage of shift register and the enabling (scan) time of the stage of shift register is less than (m−1)*16 ms, thus solving the problem that the levels of the output terminals of the shift registers in the gate driving circuit are floated during the scan (especially solving the problem that the levels of the output terminals of the latter shift registers in the gate driving circuit are floated during the scan). Therefore, the output terminal of each stage of shift register in the gate driving circuit can be maintained at a low level before the enabled scanning, avoiding the screen jitter phenomenon of the display device in displaying which is caused by the floating of voltage levels at the output terminals of the shift registers in the gate driving circuit, so as to improve the display effect.

Figure 2:
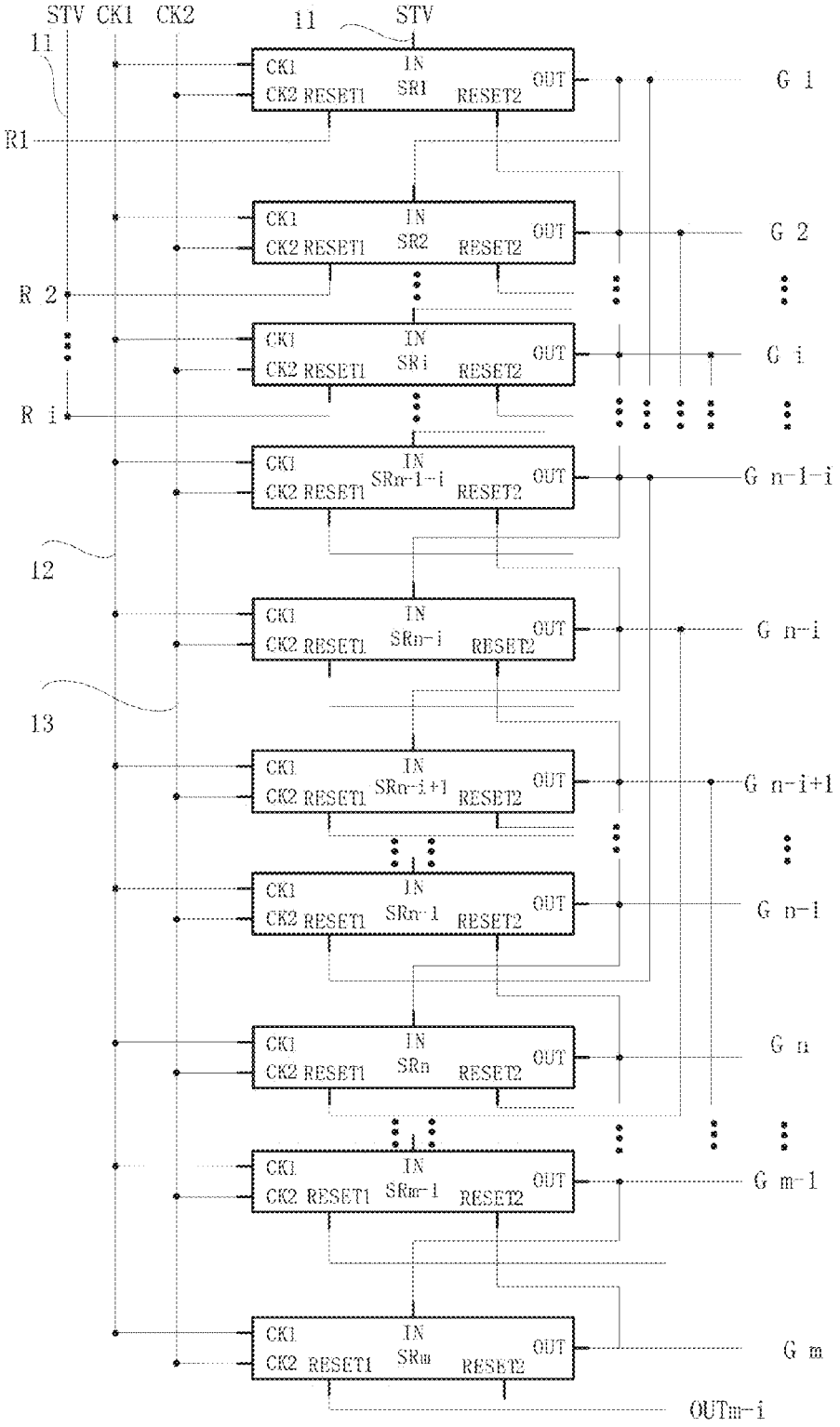
FIG. 2 is a schematic diagram showing the structure of a gate driving circuit according to another embodiment of the present invention.

FIG. 2 is a schematic diagram showing the structure of a gate driving circuit according to another embodiment of the present invention. the gate driving circuit in the present embodiment is substantially same as that in another embodiment, and the difference therebetween is in that, in the present embodiment the reset line R1 of the gate driving circuit applies the reset signal to the first reset terminal RESET1 of the first stage of shift register SRi, as shown in FIG. 2, so that the first stage of shift register SRi is reset before scanning, the reset lines R2 to Ri are all connected to the initial signal line 11, and the initial signal STV from the initial signal line 11 is respectively applied to the first reset terminals RESET1 of the second to i-th stages of shift registers SR2, . . . , SRi, so that the second to i-th stages of shift registers SR2, . . . , SRi are reset before scanning.

Specifically, the first reset terminal RESET1 of the first stage of shift register SR1 is connected to the reset line R1, to receive the reset signal from the reset line R1, so that the first stage of shift register SR1 is reset before scanning.

The first reset terminals RESET1 of the second to i-th stages of shift registers SR2, . . . , SRi receive the initial signal STV, so that the second to i-th stages of shift registers SR2, . . . , SRi are reset before scanning. Specifically, the first reset terminals RESET1 of the second to i-th stages of shift registers SR2, . . . , SRi are all connected to the initial signal line 11 to receive the initial signal, so that the second to i-th stages of shift registers SR2, . . . , SRi are reset before the scan.

The (i+1)-th stage of shift register SRi+1 to the m-th stage of shift register SRm are reset before scanning: specifically, in the case of the n-th stage of shift register SRn for example, the first reset terminal RESET1 of the n-th stage of shift register SRn is electrically connected to the output terminal OUT of the (n−i)-th stage of shift register SRn−I, to receive the output signal from the output terminal OUT of the (n−i)-th stage of shift register SRn−i, and the output signal from the output terminal OUT of the (n−i)-th stage of shift register SRn−i controls the n-th stage of shift register to reset before scanning. Similarly, the (i+1)-th stage of shift register SRi+1 to the m-th stage of shift register SRm are reset in sequence before scanning.

In the present embodiment, each of the stages of shift register is reset before scanning, where, the second to i-th stages of shift registers SR2, . . . , SRi are respectively reset before scanning through the initial signal provided by the initial signal line, so that only one initial signal line is required to achieve the resets of the second to i-th stages of shift registers SR2, . . . , SRi requires, thus reducing the amount of the initial signal lines, further reducing the area occupation of the gate driving circuit in the TFT array substrate. Since these reset lines and initial signal lines are generally located at a border region of the TFT array substrate, the reduction of the amount of the reset lines can reduce the width of the border, to achieve the effect of narrow border.

Figure 3:
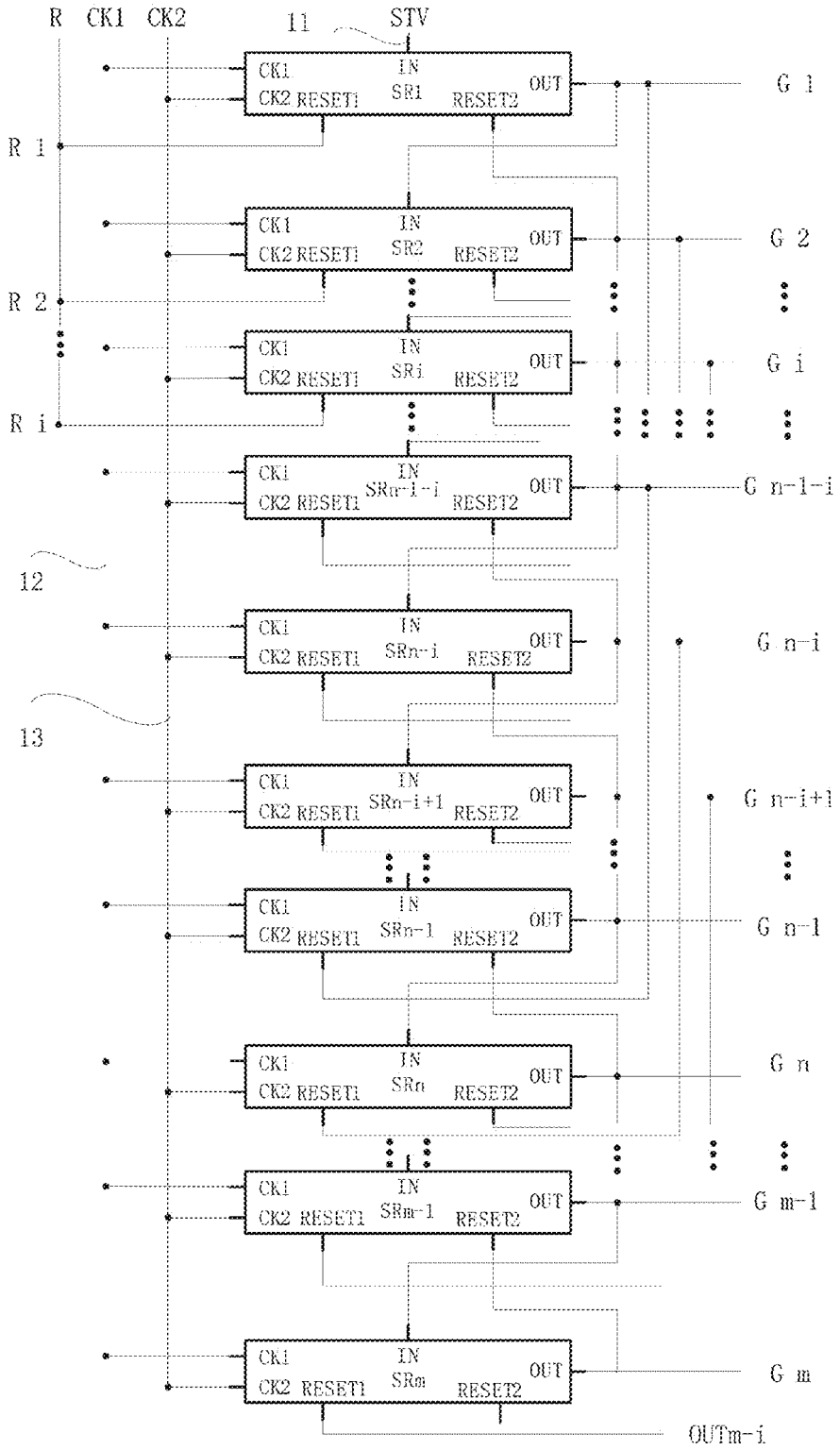
FIG. 3 is a schematic diagram showing the structure of a gate driving circuit according to another embodiment of the present invention.

FIG. 3 is a schematic diagram showing the structure of a gate driving circuit according to another embodiment of the present invention. Referring to FIG. 3, in the present embodiment, the reset lines R1, R2 to Ri are connected to the same reset signal bus R which receives the reset signals provided by a driver IC (not show) typically located at a step region of the TFT array substrate, and then the reset lines R1, R2 to Ri respectively apply the reset signals to the first to i-th stages of shift registers SR1, . . . , SRi.

Specifically, the first to i-th stages of shift registers SR1, . . . , SRi are reset before scanning, the first reset terminals RESET1 of the first to i-th stages of shift registers SR1, . . . , SRi are all connected to the reset signal bus R to receive the reset signals, so that the first to i-th stages of shift registers SR1, . . . , SRi are reset before scanning.

Specifically, the first reset terminal RESET1 of the first to i-th stages of shift registers SR1, . . . , SRi receive the reset signal applied to the reset signal bus R by the driver IC, so that the first to i-th stages of shift registers SR1, . . . , SRi are reset before scanning; specifically, the first reset terminals RESET1 of the first to i-th stages of shift registers SR1, . . . , SRi are all connected to the reset signal bus R to receive the reset signals, so that the first to i-th stages of shift registers SR1, . . . , SRi are reset before scanning.

The (i+1)-th stage of shift register SRi+1 to the m-th stage of shift register SRm are reset before scanning: specifically, in the case of the n-th stage of shift register SRn for example, the first reset terminal RESET1 of the n-th stage of shift register SRn is electrically connected to the output terminal OUT of the (n−i)-th stage of shift register SRn−i, to receive the output signal from the output terminal OUT of the (n−i)-th stage of shift register SRn−i, so that the output signal from the output terminal OUT of the (n−i)-th stage of shift register SRn−i controls the n-th stage of shift register SRn to reset before scanning; similarly, the (i+1)-th stage of shift register SRi+1 to the m-th stage of shift register SRm are reset in sequence before scanning.

In the present embodiment, the first to i-th stages of shift registers SR1, . . . , SRi are respectively reset before scanning through the reset signals provided by the reset signal bus R, so that only one reset line is required to achieve the resets of the first to i-th stages of shift registers SR1, . . . , SRi, and the resets of the (i+1)-th stage of shift register SRi+1 to the m-th stage of shift register SRm can be achieved without connection with the reset signal bus R, since said resets can be achieved by the output signal from the first to (m−i)-th stages of shift registers SRi, . . . , SRm−i, so that the reset lines corresponding to the (i+1)-th stage of shift register SRi+1 to the m-th stage of shift register SRm can be eliminated, that is, the amount of reset lines are reduced in terms of the first to i-th stages of shift registers SR1, . . . , SRi; and then the area occupation of the gate driving circuit in TFT array substrate is further reduced. Since these reset lines and reset signal bus are generally located at a border region of the TFT array substrate, the reduction of the amount of the reset lines can reduce the width of the border, to achieve the effect of narrow border.

Figure 4:
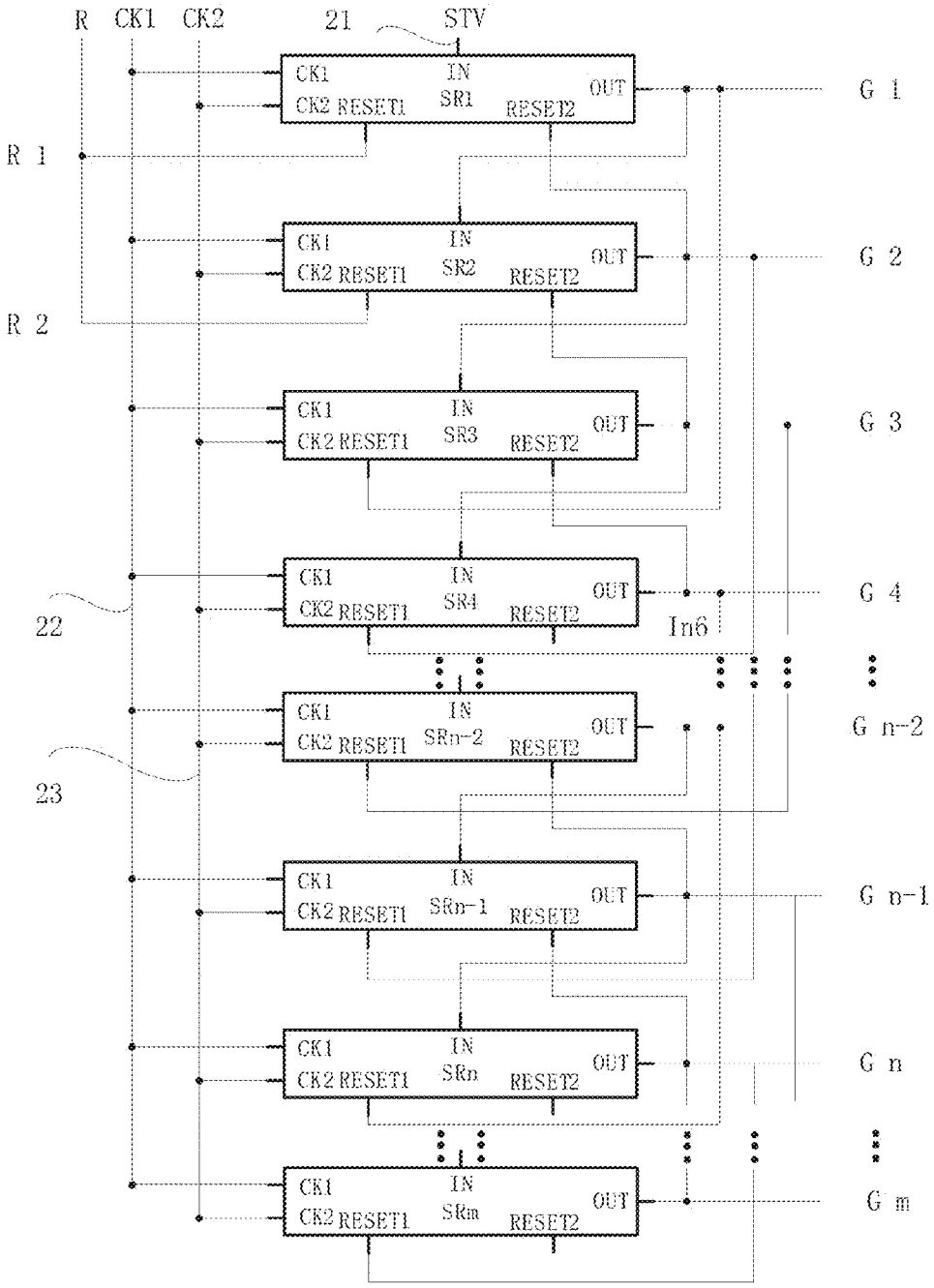
FIG. 4 is a schematic diagram showing the structure of a gate driving circuit according to another embodiment of the present invention.

FIG. 4 is a schematic diagram showing the structure of a gate driving circuit according to another embodiment of the present invention. The gate driving circuit of the present embodiment is a more specific implementation of the gate driving circuit of the first embodiment (in particular, it is the case in the first embodiment that the value of i is equal to 2). A more detailed description is given below in conjunction with the first embodiment.

Referring to FIG. 4, the gate driving circuit in the present embodiment, likewise, includes m serially-connected stages of shift register SR1, SR2, . . . , SRn, SRn−1, SRn−2, . . . , SRm, where both m and n are positive integers, and m>3≤m≤m. Each of the m stages of shift registers includes: a first reset terminal RESET1, a first input terminal IN and an output terminal OUT. The first reset terminal RESET1 of the first shift register SR1 and the first reset terminal RESET1 of the second stage of shift register SR2 are both connected to the reset signal bus R by which reset signals from a driver IC in the TFT array substrate are provided, so that the shift registers SR1 and SR2 are reset before scanning. An initial signal line 21, by which an initial signal is provided, is also included.

Specifically, in the present embodiment, the reset signal bus R outputs the reset signals to the first stage of shift register SR1 and the second stage of shift register SR2 before the start of scanning in a frame, so that the first stage of shift register SR1 and the second stage of shift register SR2 are reset before scanning. After the first stage of shift register SR1 and the second stage of shift register SR2 are reset before scanning, the initial signal line 21 provides an initial signal to the first input terminal IN of the first stage of shift register SR1, to enable a scan period of the gate driving circuit, and then each of the stages of shift registers in the gate driving circuit sequentially generates the gate driving signals. The output signal from the output terminal OUT of the first stage of shift register SR1 is also applied to the first reset terminal RESET1 of the third stage of shift register which is spaced apart from the first stage of shift register SR1 by one stage, so that before the first input terminal IN of the third stage of shift register SR3 receives the input signal, the first reset terminal RESET1 of the third stage of shift register SR3 receives the output signal from the output terminal OUT of the first stage of shift register SR1 to reset before scanning, that is, the third stage of shift register SR3 is reset before scanning after receiving the output signal from the output terminal OUT of the first stage of shift register SR1. Similarly, the output signal from the output terminal OUT of the second stage of shift register SR2 is also applied to the first reset terminal RESET1 of the fourth stage of shift register SR4 which is spaced apart from the second stage of shift register SR2 by one stage, so that before the first input terminal IN of the fourth stage of shift register SR4 receives the input signal, the first reset terminal RESET1 of the fourth stage of shift register SR4 receives the output signal from the output terminal OUT of the second stage of shift register SR2 to reset before scanning, that is, the fourth stage of shift register SR4 is reset before scanning after receiving the output signal from the output terminal OUT of the second stage of shift register SR2; likewise, other stages of shift registers (the fifth stage of shift register SR5 to the m-th stage of shift register SRm) are also reset before scanning according to this rule, which are not repeatedly discussed again in the present embodiment, as long as the following condition is satisfied: the output signal from the output terminal OUT of the (n−2)-th stage of shift register SRn−2 is applied to the first reset terminal RESET1 of the n-th stage of shift register SRn which is spaced apart from the (n−2)-th stage of shift register SRn−2 by one stage, so that before the first input terminal IN of the n-th stage of shift register SRn receives the input signal, the first reset terminal RESET1 of the n-th stage of shift register SRn receives the output signal from the output terminal OUT of the (n−2)-th stage of shift register SRn−2 to reset before scanning, that is, the n-th stage of shift register SRn is reset before scanning after receiving the output signal from the output terminal OUT of the (n−2)-th stage of shift register SRn−2, where both m and n are both positive integers, and m>3, and 3≤n≤m; in this way, each of the stages of shift registers can be reset before scanning.

In other words, for the resets of the third to m-th stages of shift registers SR3, . . . , SRm before scanning, in the case of the n-th stage of shift register for example, the first reset terminal RESET1 of the n-th stage of shift register SRn is electrically connected to the output terminal OUT of the (n−2)-th stage of shift register SRn−2, to receive the output signal from the output terminal OUT of the (n−2)-th stage of shift register SRn−2, so that the output signal from the output terminal OUT of the (n−2)-th stage of shift register SRn−2 controls the n-th stage of shift register SRn to reset before scanning, and the output terminal OUT of the n-th stage of shift register SRn is maintained at a low level before scanning. Specifically, when the value of n is 5, the first reset terminal RESET1 of the fifth stage of shift register SR5 is electrically connected to the output terminal OUT of the third stage of shift register SR3, to receive the output signal from the output terminal OUT of the third stage of shift register SR3, so that the fifth stage of shift register SR5 is reset and hence has a low voltage level before scanning, that is, before the first input terminal IN of the fifth stage of shift register SR5 receives the signal, the output terminal OUT of the fifth stage of shift register SR5 is maintained at a low level. Likewise, when the value of n is 8, the first reset terminal RESET1 of the eighth stage of shift register SR8 is electrically connected to the output signal from the output terminal OUT of the sixth stage of shift register SR6, and after receiving the output signal outputted by the output terminal OUT of the sixth stage of shift register, the eighth stage of shift register SR8 is reset before scanning, that is, before the first input terminal IN of the eighth stage of shift register SR8 receives the signal, the output terminal OUT of the eighth stage of shift register SR8 is maintained at a low level.

Furthermore, referring to FIG. 4, in the present embodiment, the gate driving circuit also includes the first clock signal line 22, the second clock signal line 23, the first level signal line (not shown) and the second level signal line (not shown), and each stage of shift register also includes the first clock signal terminal CK1, the second clock signal terminal CK2 and the second reset terminal RESET2.

The first clock signal terminal CK1 is configured to receive a first clock signal from the first clock signal line 22, and the second clock signal terminal CK2 is configured to receive a second clock signal from the second clock signal line 23.

The second reset terminal RESET2 of the n-th stage of shift register SRn is connected to the output terminal OUT of the (n+1)-th stage of shift register SRn+1, to receive the output signal from the output terminal OUT of the (n+1)-th stage of shift register SRn+1, so that the n-th stage of shift register SRn is reset after scanning, and the output signal from the output terminal OUT of the n-th stage of shift register SRn is transmitted to the first input terminal IN of the (n+1)-th stage of shift register SRn+1. Specifically, in the case of the first stage of shift register SR1 for example, the output signal from the first stage of shift register SR1 (i.e., the gate driving signal) is transmitted to the first input terminal IN of the second stage of shift register SR2, so that the second stage of shift register SR2 is enabled, and enters into an operation cycle, and then generate the gate driving signal at the output terminal OUT.

The first level signal line and the second level signal line provide the first level signal and the second level signal needed for each stage of shift register.

In the gate driving circuit provided by present embodiment, the first stage of shift register SR1 and the second stage of shift register SR2 employ the reset signal provided by the driver IC in TFT array substrate, and each of the third to m-th stages of shift registers SR3, . . . , SRm are reset before scanning under the control of the output signal from the output terminal in the stage of the shift register which is spaced apart from said each of the third to m-th stages of shift registers SR3, . . . , SRm by one stage, so that during the scan process by the shift registers in the gate driving circuit, each stage of shift register is reset sequentially before its scanning. In this way, the time interval between the enabled scanning of the shift register and the reset before scanning of the shift register is very short, avoiding that the shift registers in the gate driving circuit are reset simultaneously before scanning for one frame and hence floating of voltage levels at the output terminals of the latter shift registers is caused during the scan. Therefore, the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, thus improving the display effect.

Meanwhile, in the present embodiment, only two reset lines are needed to provide to the first stage of shift register and the second stage of shift register in order to reset all the shift registers before scanning, so that the layout area of the reset lines in the gate driving circuit is greatly reduced, further achieving the narrow border effect of the TFT array substrate.

Figure 5:
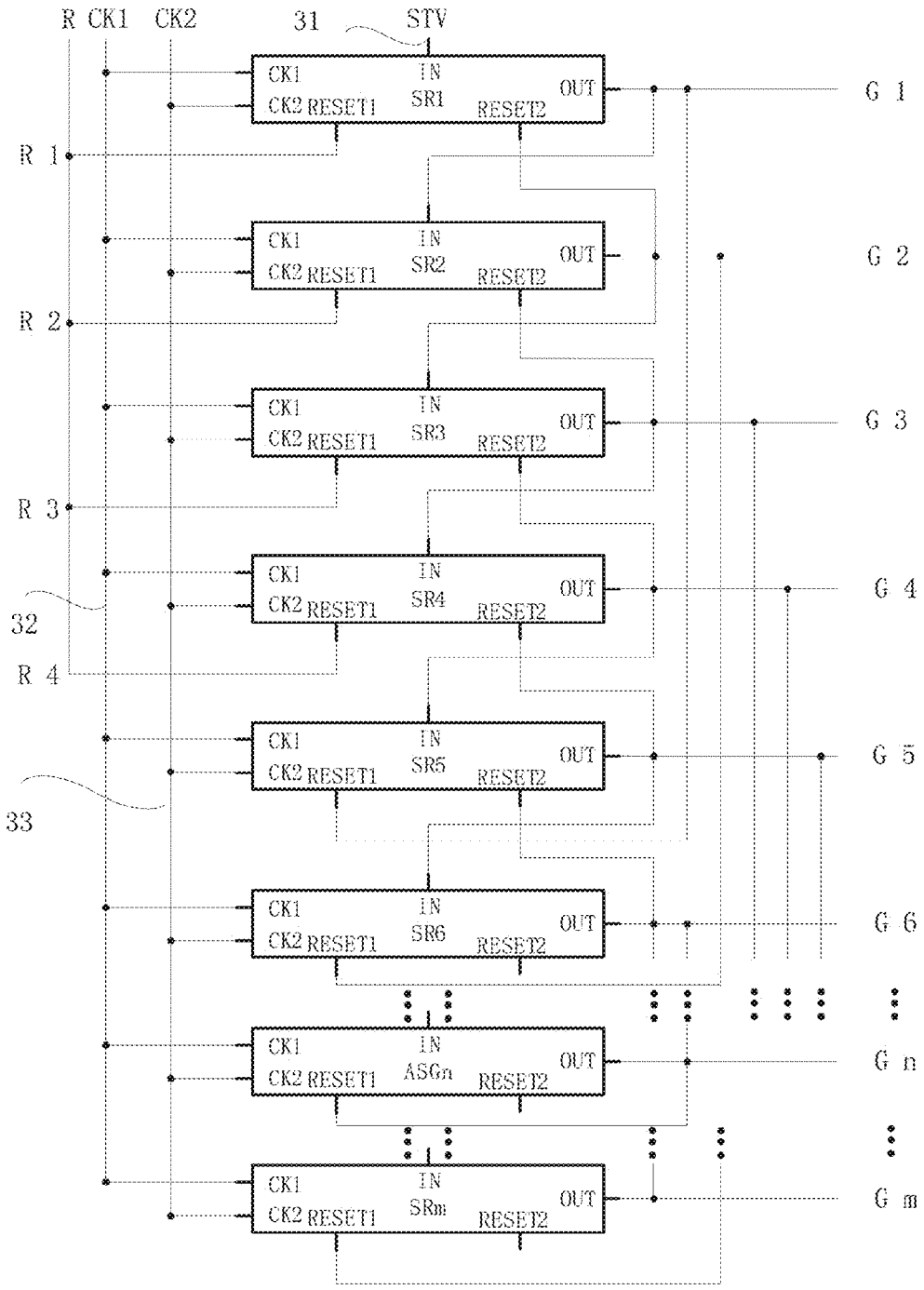
FIG. 5 is a schematic diagram showing the structure of a gate driving circuit according to another embodiment of the present invention.

FIG. 5 is a schematic diagram showing the structure of a gate driving circuit according to another embodiment of the present invention; the gate driving circuit of present embodiment is a more specific implementation of the gate driving circuit of the first embodiment (in particular, it is the case in the first embodiment that the value of i is equal to 4). A more detailed description is given below in conjunction with the first embodiment.

Referring to FIG. 5, the gate driving circuit in the present embodiment, likewise, includes m serially-connected stages of shift registers SR1, SR2, . . . , SRn, . . . , SRm, where m and n are both positive integers, and m>3, and 5≤n≤m. Each of the m stages of shift registers includes: a first reset terminal RESET1, a first input terminal IN and an output terminal OUT. FIG. 5 also shows reset lines R1, R2, R3 and R4 which are connected to a reset signal bus R providing the reset signals, so that the shift register SR1, SR2, SR3 and SR4 are reset before scanning. An initial signal line 31, by which an initial signal is provided, is also included.

Specifically, in the present embodiment, the reset signal bus R outputs the reset signals generated by the driver IC in the TFT array substrate to the first stage of shift register SR1, the second stage of shift register SR2, the third stage of shift register SR3 and the fourth stage of shift register SR4, before the start of scanning in a frame, so that the first stage of shift register SR1, the second stage of shift register SR2, the third stage of shift register SR3 and the fourth stage of shift register SR4 are reset before scanning. After the first stage of shift register SR1 to the fourth stage of shift register SR4 are reset before scanning, the initial signal line 31 provides an initial signal STV to the first input terminal IN of the first stage of shift register SR1, to enable the scan cycle of the gate driving circuit, and then each of the stages of shift registers in the gate driving circuit sequentially generates the gate driving signal. When the output signal from the output terminal OUT of the first stage of shift register is the gate driving signal, simultaneously, the gate driving signal is applied to the first reset terminal RESET1 of the fifth stage of shift register SR5 which is spaced apart from the first stage of shift register by three stages, so that before the first input terminal IN of the fifth stage of shift register SR5 receives the input signal, the first reset terminal RESET1 of the fifth stage of shift register SR5 receives the output signal from the output terminal OUT of the first stage of shift register SR1 to reset before scanning, that is, the fifth stage of shift register SR5 is reset before scanning after receiving the output signal from the output terminal OUT of the first stage of shift register SR1. Similarly, the output signal from the output terminal OUT of the second stage of shift register SR2 is also applied to the first reset terminal RESET1 of the sixth stage of shift register SR6 which is spaced apart from the second stage of shift register SR2 by three stages, so that before the first input terminal IN of the sixth stage of shift register SR6 receives the input signal, the first reset terminal RESET1 of the sixth stage of shift register SR6 receives the output signal from the output terminal OUT of the second stage of shift register SR2 to reset before scanning, that is, the sixth stage of shift register SR6 is reset before scanning after receiving the output signal from the output terminal OUT of the second stage of shift register SR2; likewise, the output signal from the output terminal OUT of the third stage of shift register SR3 also is applied to the first reset terminal RESET1 of the seventh stage of shift register SR7 which is spaced apart from the third stage of shift register SR3 by three stages, so that before the first input terminal IN of the seventh stage of shift register SR7 receives the input signal, the first reset terminal RESET1 of the seventh stage of shift register SR7 receives the output signal from the output terminal OUT of the third stage of shift register SR3 to reset before scanning, that is, the seventh stage of shift register SR7 is reset before scanning after receiving the output signal from the output terminal OUT of the third stage of shift register SR3; likewise, the output signal from the output terminal OUT of the fourth stage of shift register SR4 is also applied to the first reset terminal RESET1 of the eighth stage of shift register SR8 which is spaced apart from the fourth stage of shift register SR4 by three stages, so that before the first input terminal IN of the eighth stage of shift register SR8 receives the input signal, the first reset terminal RESET1 of the eighth stage of shift register SR8 receives the output signal from the output terminal OUT of the fourth stage of shift register SR4 to reset before scanning, that is, the eighth stage of shift register SR8 is reset before scanning after receiving the output signal from the output terminal OUT of the fourth stage of shift register SR4; likewise, the other stages of shift registers (the ninth stage of shift register SR9 to the m-th stage of shift register SRm) are also reset before scanning according to this rule, which are not repeatedly discussed again in the present embodiment, as long as the following condition is satisfied: the output signal from the output terminal OUT of the (n--4)-th stage of shift register SRn−4 is applied to the first reset terminal RESET1 of the n-th stage of shift register SRn which is spaced apart from the (n−4)-th stage of shift register SRn−4 by three stages, so that before the first input terminal IN of the n-th stage of shift register SRn receives the input signal, the first reset terminal RESET1 of the n-th stage of shift register SRn receives the output signal from the output terminal OUT of the (n−4)-th stage of shift register SRn−4 to reset before scanning, that is, the n-th stage of shift register SRn is reset before scanning after receiving the output signal from the output terminal OUT of the (n−4)-th stage of shift register SRn−4, where both m and n are both positive integers, and m>3, and 3≤n≤m; in this way, each of the stages of shift registers can be reset before scanning.

In other words, for the resets before scanning of the fifth stage of shift register SR5 to the m-th stage of shift register SRm, in the case of the n-th stage of shift register for example, the first reset terminal RESET1 of the n-th stage of shift register SRn is electrically connected to the output terminal OUT of the (n−4)-th stage of shift register SRn−4, to receive the output signal from the output terminal OUT of the (n−4)-th stage of shift register SRn−4, so that the output signal from the output terminal OUT of the (n−4)-th stage of shift register SRn−4 controls the n-th stage of shift register SRn to reset before scanning, and the output terminal OUT of the n-th stage of shift register SRn is maintained at a low level before scanning. Specifically, when the value of n is 9, the first reset terminal RESET1 of the ninth stage of shift register SR9 is electrically connected to the output terminal OUT of the fifth stage of shift register SR5, to receive the output signal from the output terminal OUT of the fifth stage of shift register SR5, so that the ninth stage of shift register SR9 is reset and hence has a low voltage level before scanning, that is, before the first input terminal IN of the ninth stage of shift register SR9 receives the signal, the output terminal OUT of the ninth stage of shift register SR9 is maintained at a low level. Likewise, when the value of n is 8, the first reset terminal RESET1 of the eighth stage of shift register SR8 is electrically connected to the output signal from the output terminal OUT of the fourth stage of shift register SR4, and after receiving the output signal outputted by the output terminal OUT of the fourth stage of shift register, the eighth stage of shift register SR8 is reset before scanning, that is, before the first input terminal IN of the eighth stage of shift register SR8 receives the signal, the output terminal OUT of the eighth stage of shift register SR8 is maintained at a low level.

Furthermore, referring to FIG. 5, in the present embodiment, the gate driving circuit also includes the first clock signal line 32, the second clock signal line 33, the first level signal line (not shown) and the second level signal line (not shown), and each stage of shift register also includes the first clock signal terminal CK1, the second clock signal terminal CK2 and the second reset terminal RESET2.

The first clock signal terminal CK1 is configured to receive the first clock signal from the first clock signal line 32, and the second clock signal terminal CK2 is configured to receive the second clock signal from the second clock signal line 33.

The second reset terminal RESET2 of the n-th stage of shift register SRn is connected to the output terminal OUT of the (n+1)-th stage of shift register SRn+1, to receive the output signal from the output terminal OUT of the (n+1)-th stage of shift register SRn+1, so that the n-th stage of shift register SRn is reset after scanning, and the output signal from the output terminal OUT of the n-th stage of shift register SRn is transmitted to the first input terminal IN of the (n+1)-th stage of shift register SRn+1.

The first level signal line and the second level signal line provides the first level signal and the second level signal needed for each stage of shift register in the gate driving circuit.

In the gate driving circuit provided by present embodiment, the first stage of shift register SR1, the second stage of shift register SR2, the third stage of shift register SR3 and the fourth stage of shift register SR4 are reset before scanning by means of the reset bus R, and each of the fifth stage of shift register SR5 to the m-th stage of shift register SRm is reset before scanning under the control of the output signal from the output terminal in the stage of the shift register which is spaced apart from said each of the fifth stage of shift register SR5 to the m-th stage of shift register SRm by three stages, so that during the scan process by the shift registers in the gate driving circuit, each stage of shift register is reset sequentially before its scanning, thus avoiding that the shift registers in the gate driving circuit are reset simultaneously before scanning for one frame and hence floating of voltage levels at the output terminals of the latter shift registers is caused during the scan. Therefore, the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, thus improving the display effect.

Figure 6:
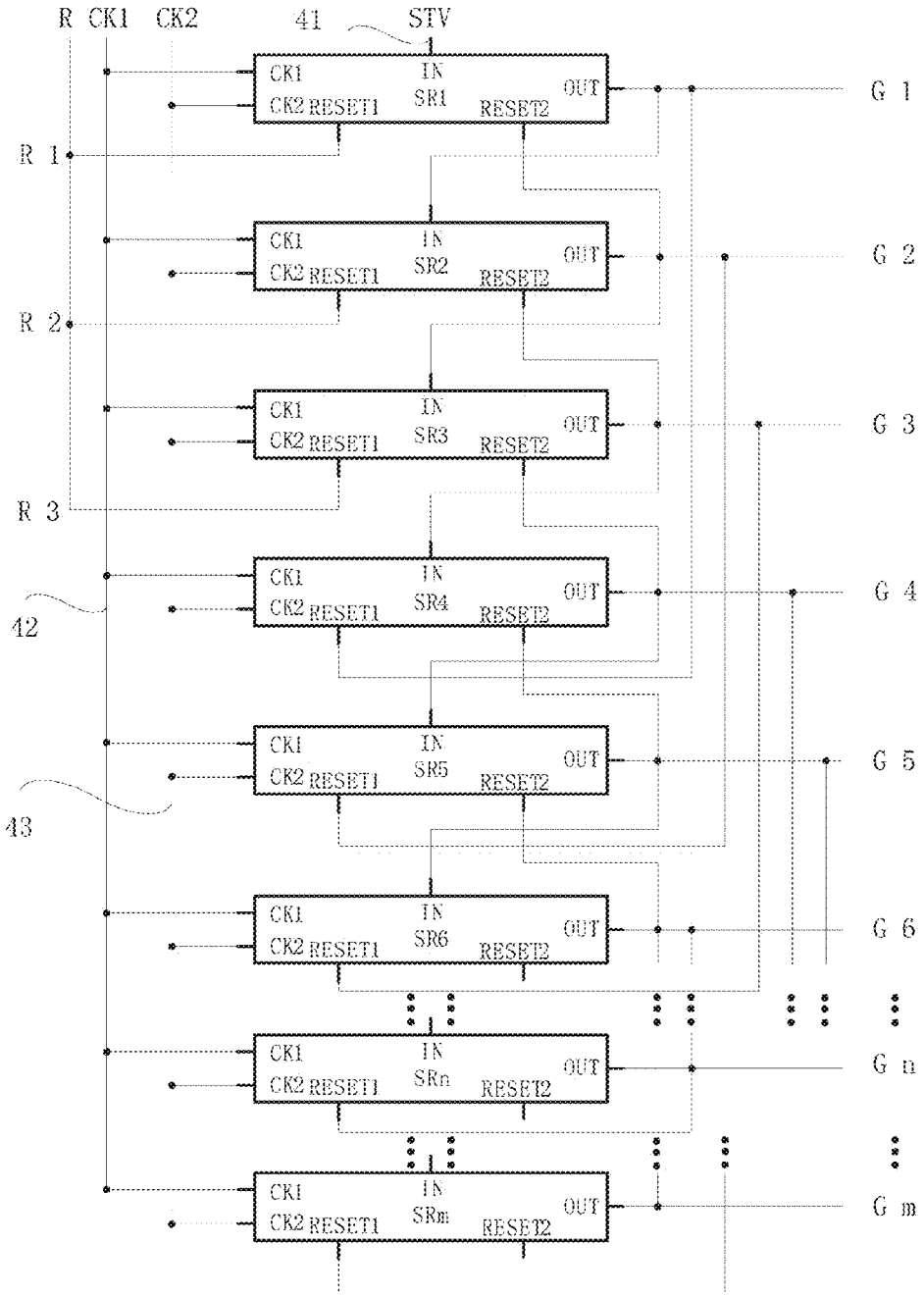
FIG. 6 is a schematic diagram showing the structure of a gate driving circuit according to another embodiment of the present invention.

FIG. 6 is a schematic diagram showing the structure of a gate driving circuit according to another embodiment of the present invention. The gate driving circuit in the present embodiment is a more specific implementation of the gate driving circuit in the first embodiment (in particular, it is the case in the first embodiment that the value of i is equal to 3). A more detailed description is given below in conjunction with the first embodiment.

Referring to FIG. 6, the gate driving circuit in the present embodiment, likewise, includes m serially-connected stages of shift register SR1, SR2, . . . , SRn, . . . , SRm, where m and n are both positive integers, m>3, and 4≤n≤m. Each of the m stages of shift registers includes: a first reset terminal RESET1, a first input terminal IN and an output terminal OUT. FIG. 6 also shows reset lines R1, R2 and R3 which are connected to a reset signal bus R providing reset signals, so that the shift registers SR1, SR2 and SR3 are reset before scanning. An initial signal line 41, by which an initial signal is provided, is also included.

Specifically, in the present embodiment, the reset signal bus R outputs the reset signals generated by the driver IC in the TFT array substrate to the first stage of shift register SR1, the second stage of shift register SR2, and the third stage of shift register SR3, before the start of scanning in a frame, so that the first stage of shift register SR1, the second stage of shift register SR2 and the third stage of shift register SR3 are reset before scanning. After the first stage of shift register SR1 to the third stage of shift register SR3 are reset before scanning, the initial signal line 41 provides an initial signal to the first input terminal IN of the first stage of shift register SR1, to enable the scan cycle of the gate driving circuit, and then each of the stages of shift registers in the gate driving circuit sequentially generates the gate driving signal. The output signal from the output terminal OUT of the first stage of shift register is also applied to the first reset terminal RESET1 of the fourth stage of shift register SR4 which is spaced apart from the first stage of shift register by two stages, so that before the first input terminal IN of the fourth stage of shift register SR4 receives the input signal, the first reset terminal RESET1 of the fourth stage of shift register SR4 receives the output signal from the output terminal OUT of the first stage of shift register SR1 to reset before scanning, that is, the fourth stage of shift register SR4 is reset before scanning after receiving the output signal from the output terminal OUT of the first stage of shift register SR1. Similarly, the output signal from the output terminal OUT of the second stage of shift register SR2 is also applied to the first reset terminal RESET1 of the fifth stage of shift register SR5 which is spaced apart from the second stage of shift register SR2 by two stages, so that before the first input terminal IN of the fifth stage of shift register SR5 receives the input signal, the first reset terminal RESET1 of the fifth stage of shift register SR5 receives the output signal from the output terminal OUT of the second stage of shift register SR2 to reset before scanning, that is, the fifth stage of shift register SR5 is reset before scanning after receiving the output signal from the output terminal OUT of the second stage of shift register SR2; likewise, the output signal from the output terminal OUT of the third stage of shift register SR3 also is applied to the first reset terminal RESET1 of the sixth stage of shift register SR6 which is spaced apart from the third stage of shift register SR3 by two stages, so that before the first input terminal IN of the sixth stage of shift register SR6 receives the input signal, the first reset terminal RESET1 of the sixth stage of shift register SR6 receives the output signal from the output terminal OUT of the third stage of shift register SR3 to reset before scanning, that is, the sixth stage of shift register SR6 is reset before scanning after receiving the output signal from the output terminal OUT of the third stage of shift register SR3; likewise, the other stages of shift registers (the seven stage of shift register SR7 to the m-th stage of shift register SRm) are also reset before scanning according to this rule, which are not repeatedly discussed again in the present embodiment, as long as the following condition is satisfied: the output signal from the output terminal OUT of the (n−3)-th stage of shift register SRn−3 is applied to the first reset terminal RESET1 of the n-th stage of shift register SRn which is spaced apart from the (n−3)-th stage of shift register SRn−3 by two stages, so that before the first input terminal IN of the n-th stage of shift register SRn receives the input signal, the first reset terminal RESET1 of the n-th stage of shift register SRn receives the output signal from the output terminal OUT of the (n−3)-th stage of shift register SRn−3 to reset before scanning, that is, the n-th stage of shift register SRn is reset before scanning after receiving the output signal from the output terminal OUT of the (n−3)-th stage of shift register SRn−3, where both m and n are both positive integers, and m>3, and 4≤n≤m; in this way, each of the stages of shift registers can be reset before scanning.

In other words, for the reset before scanning of the fourth stage of shift register SR4 to the m-th stage of shift register SRm, in the case of the n-th stage of shift register for example, the first reset terminal RESET1 of the n-th stage of shift register SRn is electrically connected to the output terminal OUT of the (n−3)-th stage of shift register SRn−3, to receive the output signal from the output terminal OUT of the (n−3)-th stage of shift register SRn−3, so that the output signal from the output terminal OUT of the (n−3)-th stage of shift register SRn−3 controls the n-th stage of shift register SRn to reset before scanning, and the output terminal OUT of the n-th stage of shift register SRn is maintained at a low level before scanning. Specifically, when the value of n is 9, the first reset terminal RESET1 of the ninth stage of shift register SR9 is electrically connected to the output terminal OUT of the sixth stage of shift register SR6, to receive the output signal from the output terminal OUT of the sixth stage of shift register SR6, so that the ninth stage of shift register SR9 is reset and hence has a low voltage level before scanning, and the output terminal OUT of the ninth stage of shift register SR9 is maintained at a low level. Likewise, when the value of n is 8, the first reset terminal RESET1 of the eighth stage of shift register SR8 is electrically connected to the output signal from the output terminal OUT of the fifth stage of shift register SR5, and after receiving the output signal outputted by the output terminal OUT of the fifth stage of shift register SR5, the eighth stage of shift register SR8 is reset before scanning, and the output terminal OUT of the eighth stage of shift register SR8 is maintained at a low level.

Furthermore, referring to FIG. 6, in the present embodiment, the gate driving circuit also includes the first clock signal line 42, the second clock signal line 43, the first level signal line (not shown) and the second level signal line (not shown), and each stage of shift register also includes the first clock signal terminal CK1, the second clock signal terminal CK2 and the second reset terminal RESET2.

The first clock signal terminal CK1 is configured to receive the first clock signal from the first clock signal line 42, and the second clock signal terminal CK2 is configured to receive the second clock signal from the second clock signal line 43.

The second reset terminal RESET2 of the n-th stage of shift register SRn is connected to the output terminal OUT of the (n+1)-th stage of shift register SRn+1, to receive the output signal from the output terminal OUT of the (n+1)-th stage of shift register SRn+1, so that the n-th stage of shift register SRn is reset after scanning; and the output signal from the output terminal OUT of the n-th stage of shift register SRn is transmitted to the first input terminal IN of the (n+1)-th stage of shift register SRn+1. Specifically, in the case of the first stage of shift register SR1 for example, the output signal of the first stage of shift register SR1 (i.e., the gate driving signal) is transmitted to the first input terminal IN of the second stage of shift register SR2, to enable the second stage of shift register SR2, thus the second stage of shift register SR2 enters into an operation cycle, and hence generates the gate driving signal at the output terminal OUT thereof.

The first level signal line and the second level signal line provides the first level signal and the second level signal needed for each stage of shift register in the gate driving circuit.

In the gate driving circuit provided by present embodiment, each of the stages of shift registers is reset before scanning, where the first stage of shift register SR1, the second stage of shift register SR2 and the third stage of shift register SR3 are reset before scanning by means of the reset line R1-R3, and each of the fourth stage of shift register SR4 to the m-th stage of shift register SRm is reset before scanning under the control of the output signal from the stage of the shift register which is spaced apart from said each of the fourth stage of shift register SR4 to the m-th stage of shift register SRm by two stages, so that during the scan process by the shift registers in the gate driving circuit, each stage of shift register is reset sequentially before its scanning. In this way, the time interval between the enabled scanning of the shift register and the resetting before scanning of the shift register is very short, thus avoiding that the shift registers in the gate driving circuit are reset simultaneously before scanning for one frame and hence floating of voltage levels at the output terminals of the latter shift registers is caused during the scan. Therefore, the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, thus improving the display effect.

It shall be noted that, the forward scanning is employed in the present embodiment as an example, but the present invention is not limited thereto, rather, the gate driving circuit in the above embodiments can also employs a backward scanning, and the forward scanning and the backward scanning are employed based on the same implementation, which is not repeatedly discussed again here. In addition, the gate driving circuit is not limited to the gate driving circuit with four phases or the gate driving circuit with eight phases. Although the gate driving circuit with four phases is employed in the present embodiment as an example, the present invention is not limited thereto.

Figure 7A:
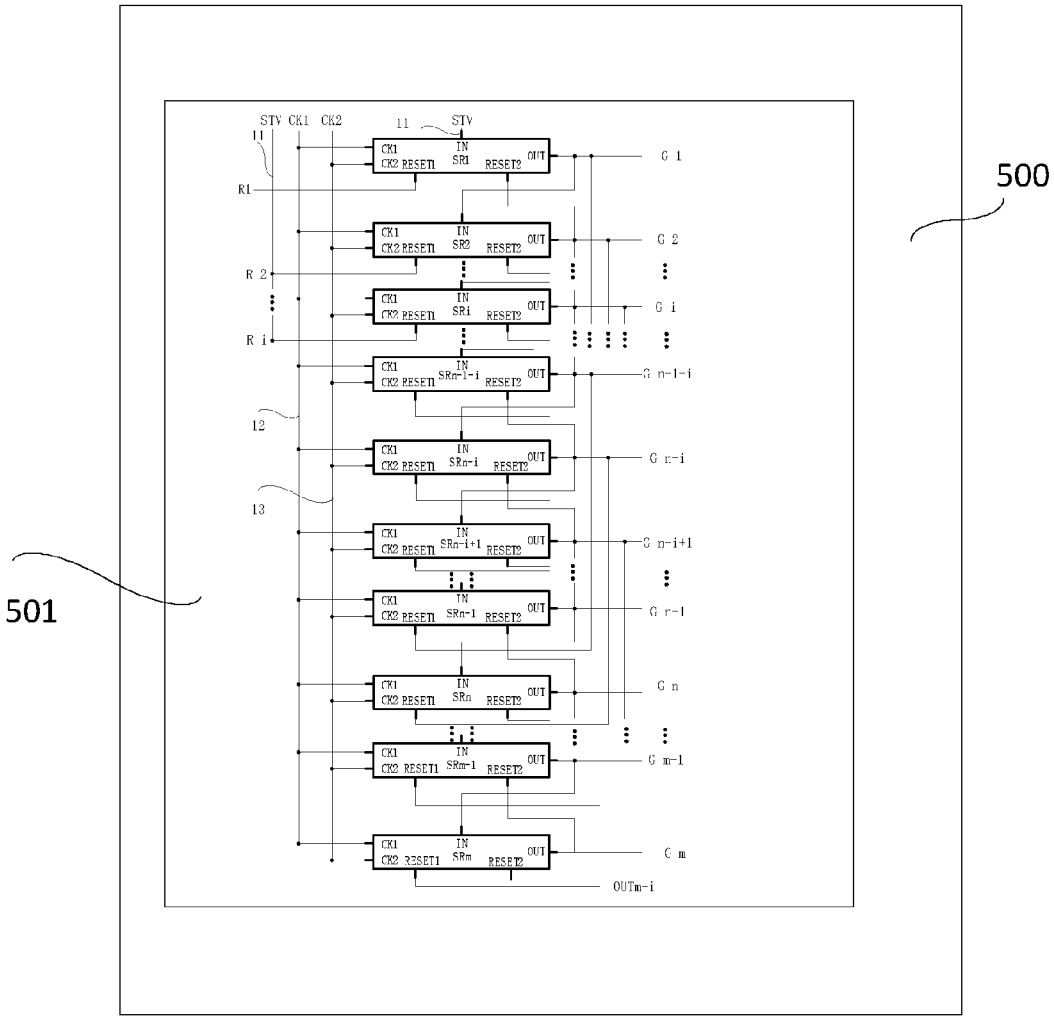
FIG. 7*a* is a schematic diagram showing the structure of a TFT array substrate according to another embodiment of the present invention.

FIG. 7*a* is a schematic diagram showing the structure of a TFT array substrate according to another embodiment of the present invention. Referring to FIG. 7*a*, in the present embodiment, a TFT array substrate circuit 500 includes a gate driving circuit 501 as one in the above embodiments. Specifically, in the present embodiment, the TFT array substrate employs an unilateral-driving, that is, the gate driving circuit 501 is formed at one side of the TFT array substrate 500.

Figure 7B:
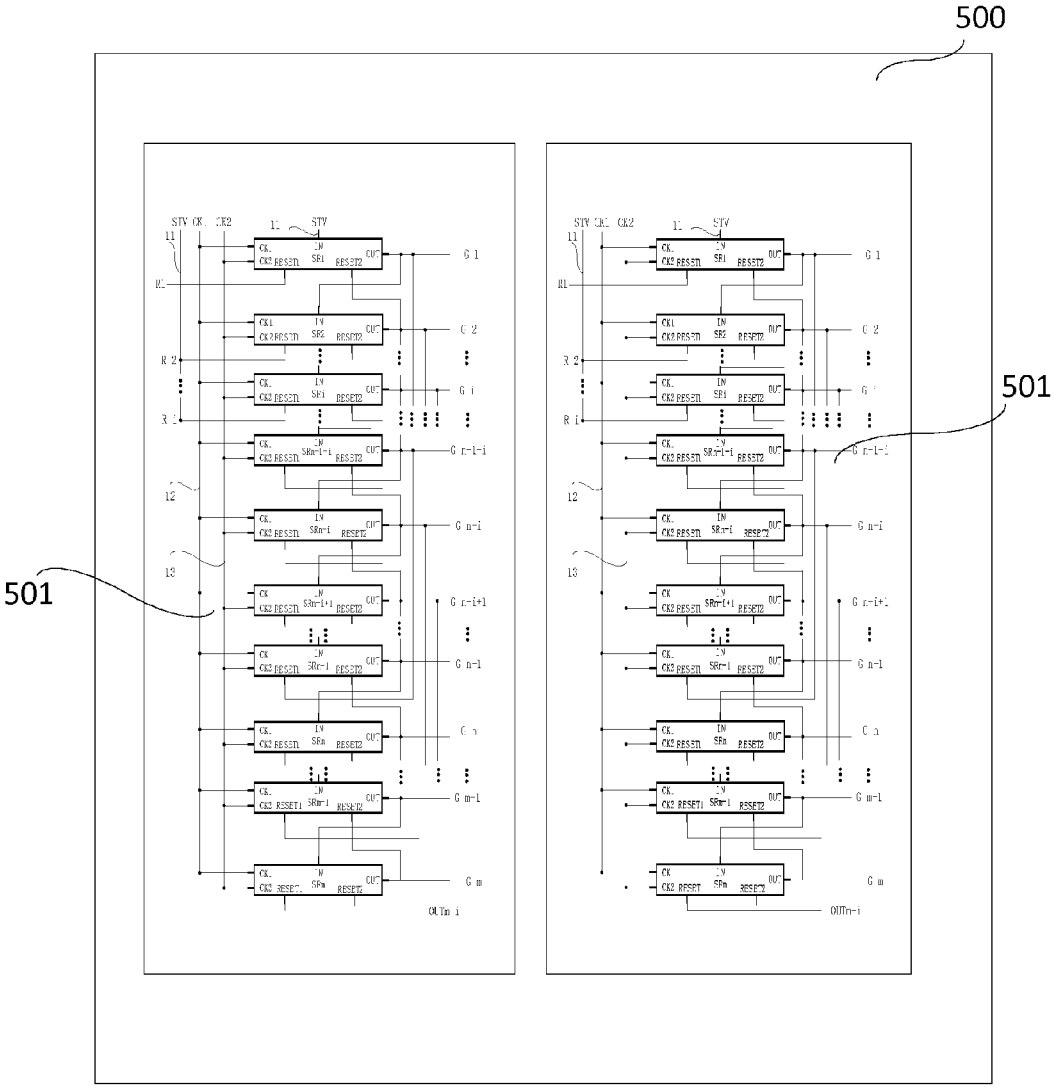
FIG. 7*b* is a schematic diagram showing the structure of the TFT array substrate according to another embodiment of the present invention.

Referring to FIG. 7*b*, which is a schematic diagram of another preferred implementation of the structure of the TFT array substrate according to the seventh embodiment of the present invention, a bilateral-driving of the TFT array substrate is applied, that is, the gate driving circuit 501 locates at both sides of the TFT array substrate.

It shall be noted that in the present embodiment, the TFT array substrate is not limited to be used in the LCD (liquid crystal display), the OLED (organic light emitting display) or the electronic paper etc. In additional, in the present embodiment, the TFT array substrate is not limited to an amorphous silicon type TFT array substrate, a LTPS type TFT array substrate or an oxide type TFT array substrate. The gate driving circuit of the TFT array substrate provided by present embodiment is not limited to the unilateral-driving and the bilateral-driving.

In the TFT array substrate provided by present embodiment, each of the stages of shift registers is reset before scanning, where each of the (1+i)-th stage of shift register to the m-th stage of shift register is reset before scanning under the control of the output signal from the output terminal in the (n−i)-th stage of shift register which is spaced apart from said each of the (1+i)-th stage of shift register to the m-th stage of shift register by i stages, so that during the scan process by the shift registers in the gate driving circuit, each stage of shift register is reset sequentially before its scanning, thus avoiding that the shift registers in the gate driving circuit are reset simultaneously before scanning for one frame and hence floating of voltage levels at the output terminals of the latter shift registers is caused during the scan. Therefore, the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, thus improving the display effect.

Meanwhile, because only a few shift registers in the gate driving circuit needs the reset lines in order to reset before scanning, the amount of the reset lines in the gate driving circuit is greatly reduced; and then achieving the narrow border effect of the TFT array substrate.

Figure 8:
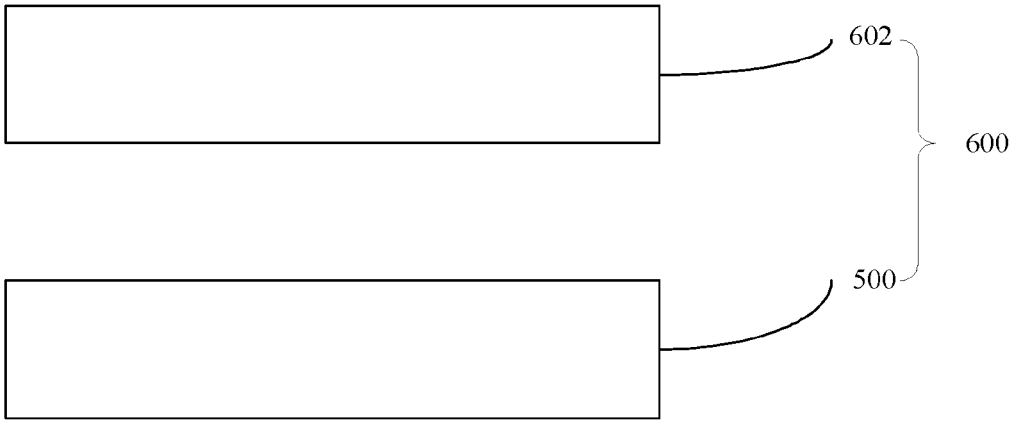
FIG. 8 is a schematic diagram showing the structure of a display panel according to another embodiment of the present invention.

FIG. 8 is a schematic diagram showing the structure of a display panel according to another embodiment of the present invention. Referring to FIG. 8, in the present embodiment, a display panel 600 includes a TFT array substrate 500, which generally further includes a color film substrate 602 provided opposite to the TFT array substrate 500, where the TFT array substrate 500 uses the one described by any of the above embodiments.

In the display panel provided by present embodiment, each of the stages of shift registers in the gate driving circuit of the display panel is reset before scanning, where each of the (1+i)-th stage of shift register to the m-th stage of shift register is reset before scanning under the control of the output signal from the output terminal in the (n−i)-th stage of shift register which is spaced apart from said each of the (1+i)-th stage of shift register to the m-th stage of shift register by i stages, so that during the scan process by the shift registers in the gate driving circuit, each stage of shift register is reset sequentially before its scanning, thus avoiding that the shift registers in the gate driving circuit are reset simultaneously before scanning for one frame and hence floating of voltage levels at the output terminals of the latter shift registers is caused during the scan. Therefore, the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, thus improving the display effect.

Meanwhile, because only a few shift registers in the gate driving circuit needs the reset lines in order to reset before scanning, the amount of the reset lines in the gate driving circuit is greatly reduced; and then achieving the narrow border effect of the display panel.

Figure 9:
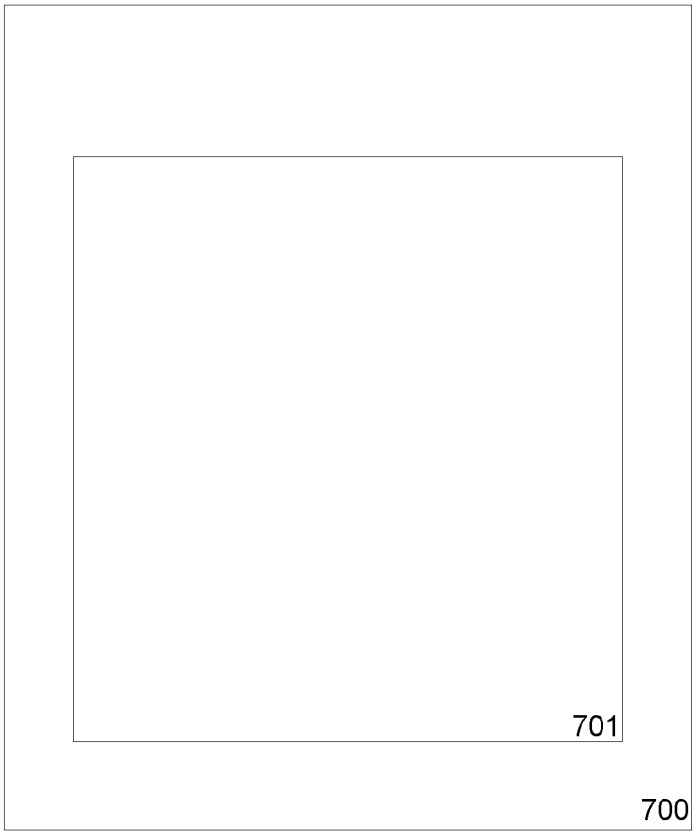
FIG. 9 is a schematic diagram showing the structure of a display device according to another embodiment of the present invention.

FIG. 9 is a schematic diagram showing the structure of a display device according to another embodiment of the present invention.

Referring to FIG. 9, the display device in the present embodiment is not limited to an organic light emitting display (OLED) device, a liquid crystal display (LCD) device or an electronic paper etc. Specifically, the display device 700 includes a display panel 701. The display panel 701 uses the display panel described in the eighth embodiment.

The display device provided by present embodiment includes m serially-connected stages of shift registers, each of which is reset before scanning, where the first to m-th stages of shift registers SR1, . . . , SRm are reset before scanning in sequence; where the first to i-th stages of shift registers SR1, . . . , SRi are reset before scanning by the first signal (the initial signal or the reset signal), and each of the (i+1)-th stage of shift register SRi+1 to the m-th stage of shift register SRm is reset before scanning by the output signal from the output terminal in the stage of shift register which is spaced apart from said each of the (i+1)-th stage of shift register SRi+1 to the m-th stage of shift register SRm by i stages. Therefore, the display device provided by the present embodiment can achieve at least one of the following effects: avoiding that the shift registers in the gate driving circuit are reset simultaneously before scanning for one frame and hence floating of voltage levels at the output terminals of the latter shift registers is caused during the scan, so that the output terminal of each stage of shift register in the gate driving circuit can be maintained at a low level before scanning, avoiding the screen jitter phenomenon of the display device in displaying which is caused by the floating of voltage levels at the output terminals of the shift registers in the gate driving circuit, improving the display effect, reducing the width of the border, and achieving the narrow border effect.

The described above is only the preferred embodiment of the present invention, and is not limited to present invention, and variations and changes can be made to the present invention by those skilled in the art. Any modifications, substitutions, improvements etc. made within the spirit and principles of the present invention should all be included in the protection scope of the present invention.

What is claimed is:

1. A gate driving circuit, comprising m stages of shift registers connected to each other in series, wherein each stage of shift register comprises a first reset terminal, a first input terminal, and an output terminal, wherein a first input terminal of the first stage of shift register is configured to receive an initial signal, and a first reset terminal of the first stage of shift register is configured to receive a reset signal, and the reset signal causes the first stage of shift register to reset before scanning, wherein first reset terminals of the second to i-th stages of shift registers are configured to receive first signals, which cause the second to i-th stages of shift registers to reset before scanning, wherein a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, wherein i, m and n are positive integers, and m>3, $2 \leqslant i \leqslant m/2$, $i<n \leqslant m$.

2. The gate driving circuit of claim 1, wherein each of the first signals is the reset signal or the initial signal.

3. The gate driving circuit of claim 2, wherein the second to i-th stages of shift registers are reset before scanning, wherein each of the first signals is the initial signal, and the first reset terminals of the second to i-th stages of shift registers are connected to an initial signal line to receive the initial signal.

4. The gate driving circuit of claim 2, wherein the second to i-th stages of shift registers are reset before scanning, wherein each of the first signals is the reset signal, and wherein all the first reset terminals of the second to i-th stages of shift registers are connected to a reset signal bus to receive the reset signal, which causes the second to i-th stages of shift registers to reset before scanning.

5. The gate driving circuit of claim 1, wherein i=2, and wherein a first reset terminal of the n-th stage of shift register is electrically connected to an output terminal of the (n−2)-th stage of shift register, so as to receive the output signal from the output terminal of the (n−2)-th stage of shift register, wherein the output signal from the output terminal of the (n−2)-th stage of shift register causes the n-th stage of shift register to reset before scanning.

6. The gate driving circuit of claim 1, wherein the initial signal is a pulse signal, and has a high voltage level in a range between about 12V and about 15V and a low voltage level in a range between about −8V and about −12V.

7. The gate driving circuit of claim 1, wherein each stage of shift register further comprises:

a first clock signal terminal connected to a first clock signal line to receive a first clock signal; and a second clock signal terminal connected to a second clock signal line to receive a second clock signal.

8. The gate driving circuit of claim 7, wherein the first clock signal and the second clock signal are both pulse signals, wherein, the first clock signal has a high voltage level in a range between about 12V and about 15V and a low voltage level in a range between about −8V and about −12V, the second clock signal has a high voltage level in a range between about 12V and about 15V and a low voltage level in a range between about −8V and about −12V.

9. The gate driving circuit of claim 7, wherein the first clock signal is inverse to the second clock signal.

10. The gate driving circuit of claim 1, wherein the each of the m stages of shift registers further comprises:

a second reset terminal;

wherein the second reset terminal of the k-th stage of shift register is connected to the output terminal of the (k+1)-th stage of shift register, so as to receive the output signal from the output terminal of the (k+1)-th stage of shift register, such that the k-th stage of shift register is reset after scanning, wherein the output signal from the output terminal of the k-th stage of shift register is transmitted to the first input terminal of the (k+1)-th stage of shift register, so as to enable the scanning of the (k+1)-th stage of shift register, and wherein k is a positive integer, and $1 \leqslant k \leqslant m-1$.

11. The gate driving circuit of claim 1, wherein each of the m stages of shift registers comprises:

a first transistor, wherein a gate electrode of the first transistor is electrically connected to the first input terminal of the stage of shift register, and a source electrode of the first transistor is configured to receive a first level signal;

a second transistor, wherein a gate electrode of the second transistor is electrically connected to the second reset terminal of the stage of shift register, wherein a drain electrode of the second transistor is electrically connected to a drain electrode of the first transistor, and wherein a source electrode of second transistor is configured to receive a second level signal;

a third transistor, wherein a gate electrode of the third transistor is electrically connected to the drain electrode of the first transistor and is further connected to the output terminal of the stage of shift register via a first capacitor, wherein a drain electrode of the third transistor is electrically connected to the output terminal, and wherein a source electrode is connected to the second clock signal terminal to receive the second clock signal;

a fourth transistor, wherein a drain electrode of the fourth transistor is electrically connected to the drain electrode of the first transistor, and wherein a source electrode of the fourth transistor is configured to receive the second level signal;

a fifth transistor, wherein a gate electrode of the fifth transistor is electrically connected to the drain electrode of the first transistor, wherein a source electrode of the fifth transistor is connected to the second clock signal terminal via a second capacitor, and wherein a drain electrode of the fifth transistor is configured to receive the second level signal;

a sixth transistor, wherein a gate electrode of the sixth transistor is electrically connected to both the gate electrode of the fourth transistor and the source electrode of the fifth transistor, wherein a source electrode of the sixth transistor is electrically connected to the output terminal, and wherein a drain electrode of the sixth transistor is configured to receive the second level signal;

a seventh transistor, wherein a gate electrode of the seventh transistor is electrically connected to the first clock signal terminal to receive the first clock signal, wherein a drain electrode of the seventh transistor is electrically connected to the output terminal, and wherein a source electrode of the seventh transistor is configured to receive the second level signal;

an eighth transistor, wherein a gate electrode of the eighth transistor is electrically connected to the first reset terminal of the stage of shift register, wherein a drain electrode of the eighth transistor is electrically connected to the drain electrode of the first transistor, and wherein a source electrode of the eighth transistor is configured to receive the second level signal; and a ninth transistor, wherein a gate electrode of the ninth transistor is electrically connected to both the gate electrode of the eighth transistor and the first reset terminal of the stage of shift register, wherein a source electrode of the ninth transistor is electrically connected to the output terminal of the stage of shift register, and wherein a drain electrode of the ninth transistor is configured to receive the second level signal.

12. The gate driving circuit of claim 11, wherein the first level signal has a voltage level in a range between about 12V and about 15V, and wherein the second level signal has a voltage level in a range between about −8V and about −12V.

13. The gate driving circuit of claim 11, wherein the first transistor to the ninth transistor are NMOS transistors or PMOS transistors.

14. The gate driving circuit of claim 11, wherein the output signal from the output terminal of the (n−i)-th stage of shift register is applied to the gate electrodes of the eighth and ninth transistors of the n-th stage of shift register by the first reset terminal of the n-th stage of shift register, so as to turn the eighth transistor and the ninth transistor on or off.

15. The gate driving circuit of claim 14, wherein in response to the eighth transistor and the ninth transistor of the n-th stage of shift register being on, the level of the drain electrode of the first transistor of the n-th stage of shift register and the level of the output terminal of the n-th stage of shift register is pulled down to a low level through the turned-on eighth transistor and turned-on the ninth transistor, so as to reset the n-th stage of shift register before scanning.

16. The gate driving circuit of claim 15, wherein the first reset terminal of the first stage of shift register is configured to receive the reset signal, which causes the turning on or off of the eighth transistor and the ninth transistor; and the first reset terminals of the second to i-th stages of shift registers are configured to receive the first signals, which cause the turning on or off of the eighth transistor and the ninth transistor of the second to i-th stages of shift registers correspondingly.

17. The gate driving circuit of claim 16, wherein in response to the eighth transistor and the ninth transistor of the first stage of shift register being on, the level of the drain electrode of the first transistor of the first stage of shift register and the level of the output terminal of the first state of shift register are pulled down to a low level by the second level signal through the turned-on eighth and the turned-on ninth transistors, so as to reset the first stage of shift register before scanning, and wherein in response to the eighth transistor and the ninth transistor of the corresponding second to i-th stages of shift registers being on, the level of the drain electrode of the first transistor of the corresponding second to i-th stages of shift registers and the level of the output terminal of the corresponding second t i-th stages of shift registers are pulled down to a low level by the second level signal through the turned-on eighth transistor and the turned-on ninth transistor, so as to reset the second to i-th stages of shift registers before scanning.

18. A TFT array substrate, comprising a gate driving circuit, wherein the gate driving circuit comprises m stages of shift registers connected to each other in series, wherein each stage of shift register comprises a first reset terminal, a first input terminal, and an output terminal, wherein a first input terminal of the first stage of shift register is configured to receive an initial signal, and a first reset terminal of the first stage of shift register is configured to receive a reset signal, and the reset signal causes the first stage of shift register to reset before scanning, wherein first reset terminals of the second to i-th stages of shift registers are configured to receive first signals, which cause the second to i-th stages of shift registers to reset before scanning, wherein a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, wherein i, m and n are positive integers, and $m>3$, $2\leqslant i\leqslant m/2$, $i<n\leqslant m$.

19. A display device, comprising a TFT array substrate, wherein the TFT array substrate comprises a gate driving circuit, where the gate driving circuit comprises m stages of shift registers connected to each other in series, wherein each stage of shift register comprises a first reset terminal, a first input terminal, and an output terminal, wherein a first input terminal of the first stage of shift register is configured to receive an initial signal, and a first reset terminal of the first stage of shift register is configured to receive a reset signal, and the reset signal causes the first stage of shift register to reset before scanning, wherein first reset terminals of the second to i-th stages of shift registers are configured to receive first signals, which cause the second to i-th stages of shift registers to reset before scanning, wherein a first reset terminal of the n-th stage of shift register is electrically connected to an output terminal of the (n−i)-th stage of shift register to receive an output signal from the output terminal of the (n−i)-th stage of shift register, such that the output signal from the output terminal of the (n−i)-th stage of shift register causes the n-th stage of shift register to reset before scanning, wherein i, m and n are positive integers, and $m>3$, $2\leqslant i\leqslant m/2$, $i<n\leqslant m$.

* * * * *